US011817643B2

(12) United States Patent
Park et al.

(10) Patent No.: US 11,817,643 B2
(45) Date of Patent: Nov. 14, 2023

(54) CAVITY FILTER AND CONNECTING STRUCTURE INCLUDED THEREIN

(71) Applicant: KMW INC., Hwaseong-si (KR)

(72) Inventors: Nam Shin Park, Hwaseong-si (KR); Joung Hoe Kim, Hwaseong-si (KR); Sung Ho Jang, Yongin-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 17/948,385

(22) Filed: Sep. 20, 2022

(65) Prior Publication Data

US 2023/0018912 A1 Jan. 19, 2023

Related U.S. Application Data

(63) Continuation of application No. 17/119,530, filed on Dec. 11, 2020, now Pat. No. 11,482,803, which is a (Continued)

(30) Foreign Application Priority Data

Jun. 12, 2018 (KR) ..... 10-2018-0067398
Jun. 12, 2019 (KR) ..... 10-2019-0069125

(51) Int. Cl.
*H01R 12/71* (2011.01)
*H01P 1/207* (2006.01)
(Continued)

(52) U.S. Cl.
CPC ..... *H01R 12/714* (2013.01); *H01P 1/207* (2013.01); *H01R 12/7076* (2013.01); *H01R 13/2407* (2013.01)

(58) Field of Classification Search
CPC ..... H01R 12/714; H01R 12/7076; H01R 13/2407; H01P 1/207
(Continued)

(56) References Cited

U.S. PATENT DOCUMENTS 5,618,205 A * 4/1997 Riddle ..... H01P 5/085 333/260
6,094,115 A * 7/2000 Nguyen ..... H01R 12/7082 333/260
(Continued)

FOREIGN PATENT DOCUMENTS

CN 202282433 U * 6/2012
CN 203039061 U * 7/2013
(Continued)

OTHER PUBLICATIONS

International Search Report for PCT/KR2019/007081 dated Sep. 20, 2019 and its English translation.
(Continued)

*Primary Examiner* — Peter G Leigh
(74) *Attorney, Agent, or Firm* — INSIGHT LAW GROUP, PLLC; Seung Lee

(57) ABSTRACT

The present invention relates to a cavity filter including: an RF signal connecting portion spaced apart, by a predetermined distance, from an outer member having an electrode pad provided on a surface thereof; and a terminal portion configured to electrically connect the electrode pad of the outer member and the RF signal connecting portion so as to absorb assembly tolerance existing at the predetermined distance and to prevent disconnection of the electric flow between the electrode pad and the RF signal connecting portion, wherein a part of the terminal portion, positioned between the electrode pad and the RF signal connecting portion, is elastically deformed to absorb assembly tolerance existing in a terminal insertion port. Therefore, the cavity filter can efficiently absorb assembly tolerance which occurs through assembly design, and prevent disconnection of an electric flow, thereby preventing degradation in performance of an antenna device.

19 Claims, 40 Drawing Sheets

Related U.S. Application Data continuation of application No. PCT/KR2019/007081, filed on Jun. 12, 2019.

(51) Int. Cl.
*H01R 12/70* (2011.01)
*H01R 13/24* (2006.01)

(58) Field of Classification Search
USPC ..... 439/620, 620.01
See application file for complete search history.

(56) References Cited

U.S. PATENT DOCUMENTS

| | | | | |
|---|---|---|---|---|
| 6,166,615 | A | 12/2000 | Winslow et al. | |
| 2003/0001697 | A1* | 1/2003 | Bennett | H01P 1/2039 333/204 |
| 2006/0038640 | A1 | 2/2006 | D'Ostilio | |
| 2008/0258848 | A1 | 10/2008 | Quan et al. | |
| 2010/0127801 | A1* | 5/2010 | Adkins | H01P 1/202 333/206 |
| 2011/0312215 | A1 | 12/2011 | Uesaka et al. | |
| 2015/0061794 | A1 | 3/2015 | Tong | |
| 2017/0310005 | A1 | 10/2017 | Kang et al. | |
| 2018/0131153 | A1 | 5/2018 | Flaherty, IV | |

FOREIGN PATENT DOCUMENTS

| | | | | | |
|---|---|---|---|---|---|
| CN | 102361109 | B | * | 12/2013 | |
| CN | 204030175 | U | * | 12/2014 | H01R 13/02 |
| CN | 204243344 | U | | 4/2015 | |
| CN | 106299780 | A | * | 1/2017 | |
| CN | 106953147 | A | * | 7/2017 | H01P 1/207 |
| CN | 107134610 | A | * | 9/2017 | |
| CN | 206774649 | U | * | 12/2017 | |
| CN | 206864586 | U | * | 1/2018 | |
| JP | H03-44868 | U | | 4/1991 | |
| JP | H08-031479 | A | | 2/1996 | |
| JP | H11-150347 | A | | 6/1999 | |
| JP | 2003-332009 | A | | 11/2003 | |
| JP | 2004-227948 | A | | 8/2004 | |
| JP | 2007-006529 | A | | 1/2007 | |
| JP | 2007-305531 | A | | 11/2007 | |
| JP | 2013-008467 | A | | 1/2013 | |
| JP | 2017-535183 | A | | 11/2017 | |
| KR | 20080082803 | A | * | 9/2008 | H01P 7/04 |
| KR | 10-2011-0041919 | A | | 4/2011 | |
| KR | 10-1036127 | B1 | | 5/2011 | |
| KR | 10-1083994 | A | | 11/2011 | |
| KR | 10-1569730 | B1 | | 11/2015 | |
| WO | 2018/093176 | A2 | | 5/2018 | |

OTHER PUBLICATIONS

First office action dated Jul. 1, 2021 for Chinese Application No. 201980040133.2.
Extended European Search Report dated Feb. 16, 2022 for European Application No. 19819354.2.
First office action dated Jan. 18, 2022 for Japanese Application No. 2020-568964.
Non-final office action dated Jul. 12, 2022 from the Japanese Patent Office for Japanese Application No. 2020-568964.
Non-final Office Action dated Dec. 7, 2021 for U.S. Appl. No. 17/119,530.
Notice of Allowance dated Jun. 20, 2022 for U.S. Appl. No. 17/119,530.
Notice of Allowance dated Sep. 20, 2022 for U.S. Appl. No. 17/119,530.
Notice of Allowance dated Feb. 14, 2023 from the Japanese Patent Office for Japanese Application No. 2020-568964.

* cited by examiner

CAVITY FILTER AND CONNECTING STRUCTURE INCLUDED THEREIN

CROSS-REFERENCE TO RELATED APPLICATIONS

This application is a Continuation Application of U.S. application Ser. No. 17/119,530, filed Dec. 11, 2020 (now pending), which is a Continuation Application of International Application No. PCT/KR2019/007081, filed on Jun. 12, 2019, which claims priority and benefits of Korean Application Nos. 10-2018-0067398, filed on Jun. 12, 2018, and 10-2019-0069125, filed on Jun. 12, 2019, the disclosures of which are incorporated herein by reference in their entirety.

TECHNICAL FIELD

The present invention relates to a cavity filter and a connecting structure included therein, and more particularly, to a cavity filter for a massive MIMO (Multiple Input Multiple Output) antenna, which improves a connector fastening structure between a filter and a PCB (Printed Circuit Board) in consideration of assembly performance and size, and a connecting structure included therein.

BACKGROUND ART

The contents described in this section simply provide background information on the present disclosure, and do not constitute the related art.

MIMO (Multiple Input Multiple Output) refers to a technology capable of significantly increasing a data transmission capacity by using a plurality of antennas, and is a spatial multiplexing technique in which a transmitter transmits different data through respective transmitting antennas and a receiver sorts the transmitted data through a suitable signal processing operation. Therefore, when the number of transmitting antennas and the number of receiving antennas are increased at the same time, the channel capacity may be raised to transmit more data. For example, when the number of antennas is increased to 10, it is possible to secure a channel capacity ten times larger than in a current single antenna system, even though the same frequency band is used.

In the 4G LTE-advanced technology, 8 antennas are used. According to the current pre-5G technology, a product having 64 or 128 antennas mounted therein is being developed. When the 5G technology is commercialized, it is expected that base station equipment with much more antennas will be used. This technology is referred to as massive MIMO. Currently, cells are operated in a 2D manner. However, when the massive MIMO technology is introduced, 3D-beamforming becomes possible. Thus, the massive MIMO technology is also referred to as FD (Full Dimension)—MIMO.

According to the massive MIMO technology, the numbers of transceivers and filters are increased with the increase in number of antennas. As of 2014, 200,000 or more base stations are installed in Korea. That is, there is a need for a cavity filter structure which is easily mounted while minimizing a mounting space. Furthermore, there is a need for an RF signal line connecting structure which provides the same filter characteristic even after individually tuned cavity filters are mounted in antennas.

An RF filter having a cavity structure includes a resonator provided in a box structure formed of a metallic conductor, the resonator being configured as a resonant bar or the like. Thus, the RF filter has only a natural frequency of electromagnetic field to transmit only a specific frequency, e.g. an ultra-high frequency, through resonance. A band pass filter with such a cavity structure has a low insertion loss and high power. Thus, the band pass filter is utilized in various manners as a filter for a mobile communication base station antenna.

DISCLOSURE

Technical Problem

An object of the present invention is to provide a cavity filter which has a slimmer and more compact structure and includes an RF connector embedded in a filter body in a thickness direction thereof, and a connecting structure included therein.

Another object of the present invention is to provide a cavity filter which is assembled through an assembly method capable of minimizing the accumulation amount of assembly tolerance which occurs when a plurality of filters are assembled, and has an RF signal connection structure that can facilitate mounting and uniformly maintain the frequency characteristics of the filters, and a connecting structure included therein.

Still another object of the present disclosure is to provide a cavity filter which can prevent a signal loss by applying lateral tension while allowing a relative motion in the case of a separable RF pin, and a connecting structure therein.

Yet another object of the present disclosure is to provide a cavity filter which can maintain a constant contact area between two members to be electrically connected to each other, while absorbing assembly tolerance between the two members, and be installed through a clear and simple method, and a connecting structure included therein.

The technical problems of the present disclosure are not limited to the above-described technical problems, and other technical problems which are not mentioned can be clearly understood by the person skilled in the art from the following descriptions.

Technical Solution

In one general aspect, a cavity filter includes: an RF signal connecting portion spaced apart, by a predetermined distance, from an outer member having an electrode pad provided on a surface thereof; and a terminal portion configured to electrically connect the electrode pad of the outer member and the RF signal connecting portion so as to absorb assembly tolerance existing at the predetermined distance and to prevent disconnection of the electric flow between the electrode pad and the RF signal connecting portion, wherein a part of the terminal portion, positioned between the electrode pad and the RF signal connecting portion, is elastically deformed to absorb assembly tolerance existing in a terminal insertion port.

The terminal portion may be provided as a single terminal portion in the terminal insertion port.

The terminal portion may include: a first side terminal contacted with the electrode pad, and elastically deformed by an assembly force provided by an assembler; and a second side terminal connected to the first side terminal, fixed so as not to be moved in the terminal insertion port, and having a lower end portion soldered and fixed to the RF signal connecting portion.

The terminal portion may include: a first side terminal contacted with the electrode pad, and moved in the terminal insertion port by an assembly force provided by an assembler; and a second side terminal connected to the first side terminal, elastically deformed by the assembly force provided from the first side terminal, and soldered and fixed to the RF signal connecting portion.

The first side terminal may have an upper end portion formed in a question mark shape.

The first side terminal and the second side terminal may be each made of a conductive material.

The cavity filter may further include a dielectric body inserted into the terminal insertion port so as to cover a part of the terminal portion.

The cavity filter may further include a reinforcement plate inserted into the terminal insertion port and configured to fix a part of the terminal portion.

Any one of the first side terminal and the second side terminal may have a plurality of tension cut portions elongated in a top-to-bottom direction, wherein the tension cut portions may be provided in the second side terminal, and an upper end portion of the second side terminal may be housed in a lower end portion of the first side terminal.

The terminal portion provided as the single terminal portion may be bent and connected to the RF signal connecting portion provided on one side right under the terminal insertion port.

The terminal portion provided as the single terminal portion may have an elastic deformation portion which is elastically deformed by the assembly force.

The elastic deformation portion may be formed in a partially cut ring shape

The elastic deformation portion may be bent in a zigzag shape.

In another general aspect, a connecting structure includes: an RF signal connecting portion spaced apart, by a predetermined distance, from an outer member having an electrode pad provided on a surface thereof; and a terminal portion configured to electrically connect the electrode pad of the outer member and the RF signal connecting portion so as to absorb assembly tolerance existing at the predetermined distance and to prevent disconnection of the electric flow between the electrode pad and the RF signal connecting portion, wherein a part of the terminal portion, positioned between the electrode pad and the RF signal connecting portion, is elastically deformed to absorb assembly tolerance existing in a terminal insertion port.

Advantageous Effects

In accordance with the embodiments of the present disclosure, the cavity filter may have a slimmer and more compact structure because the RF connector is embedded in the filter body in the thickness direction thereof, be assembled through an assembly method capable of minimizing the accumulation amount of assembly tolerance which occurs when a plurality of filters are assembled, facilitate the RF signal connection structure to be easily mounted and uniformly maintain the frequency characteristics of the filters, and provide stable connection by applying lateral tension while allowing a relative motion, thereby preventing degradation in antenna performance.

BEST MODE

Figure 1:
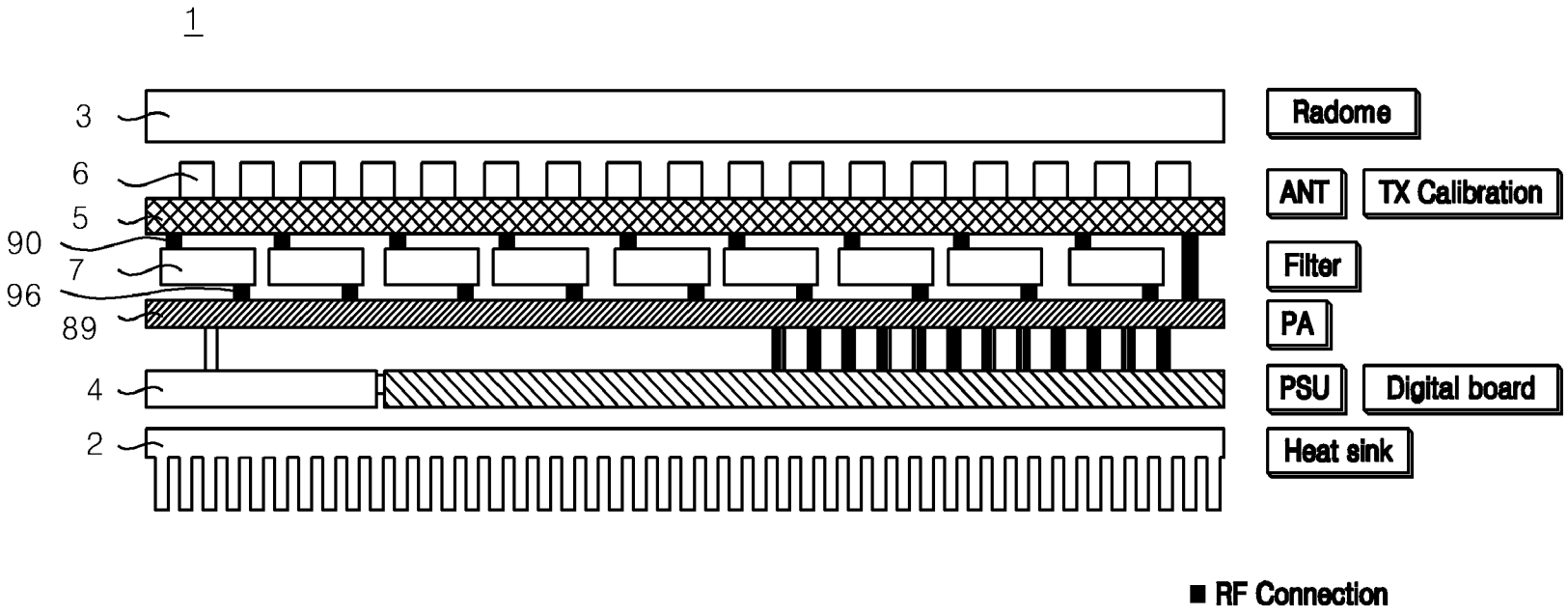
FIG. 1 is a diagram schematically illustrating a stacked structure of a massive MIMO antenna.

Hereafter, some embodiments of the present disclosure will be described in detail with reference to the accompanying drawings. It should be noted that, when components in each of the drawings are denoted by reference numerals, the same components are represented by like reference numerals, even though the components are displayed on different drawings. Furthermore, when it is determined that the detailed descriptions of publicly known components or functions related to the present disclosure disturb understandings of the embodiments of the present disclosure, the detailed descriptions thereof will be omitted herein.

When the components of the embodiments of the present disclosure are described, the terms such as first, second, A, B, (a) and (b) may be used. Each of such terms is only used to distinguish the corresponding component from other components, and the nature or order of the corresponding component is not limited by the term. Furthermore, all terms used herein, which include technical or scientific terms, may have the same meanings as those understood by those skilled in the art to which the present disclosure pertains, as long as the terms are not differently defined. The terms defined in a generally used dictionary should be analyzed to have meanings which coincide with contextual meanings in the related art. As long as the terms are not clearly defined in this specification, the terms are not analyzed as ideal or excessively formal meanings.

FIG. 1 is a diagram schematically illustrating a stacked structure of a massive MIMO antenna.

FIG. 1 only illustrates an exemplary exterior of an antenna device 1 in which an antenna assembly including a cavity filter in accordance with an embodiment of the present disclosure is embedded, and does not limit the exterior of the antenna device 1 when components are actually stacked.

The antenna device 1 includes a housing 2 having a heat sink formed therein and a radome 3 coupled to the housing 2. Between the housing 2 and the radome 3, an antenna assembly may be embedded.

A PSU (Power Supply Unit) 4 is coupled to the bottom of the housing 2 through a docking structure, for example, and provides operation power for operating communication parts included in the antenna assembly.

Typically, the antenna assembly has a structure in which an equal number of cavity filters 7 to the number of antennas are disposed on a rear surface of an antenna board 5 having a plurality of antenna elements 6 arranged on a front surface thereof, and a related PCB 8 is subsequently stacked. The cavity filters 7 may be thoroughly tuned and verified to individually have frequency characteristics suitable for the specification, and prepared before mounted on the antenna board 5. Such a tuning and verifying process may be rapidly performed in an environment with the same characteristics as the mounting state.

Figure 2:
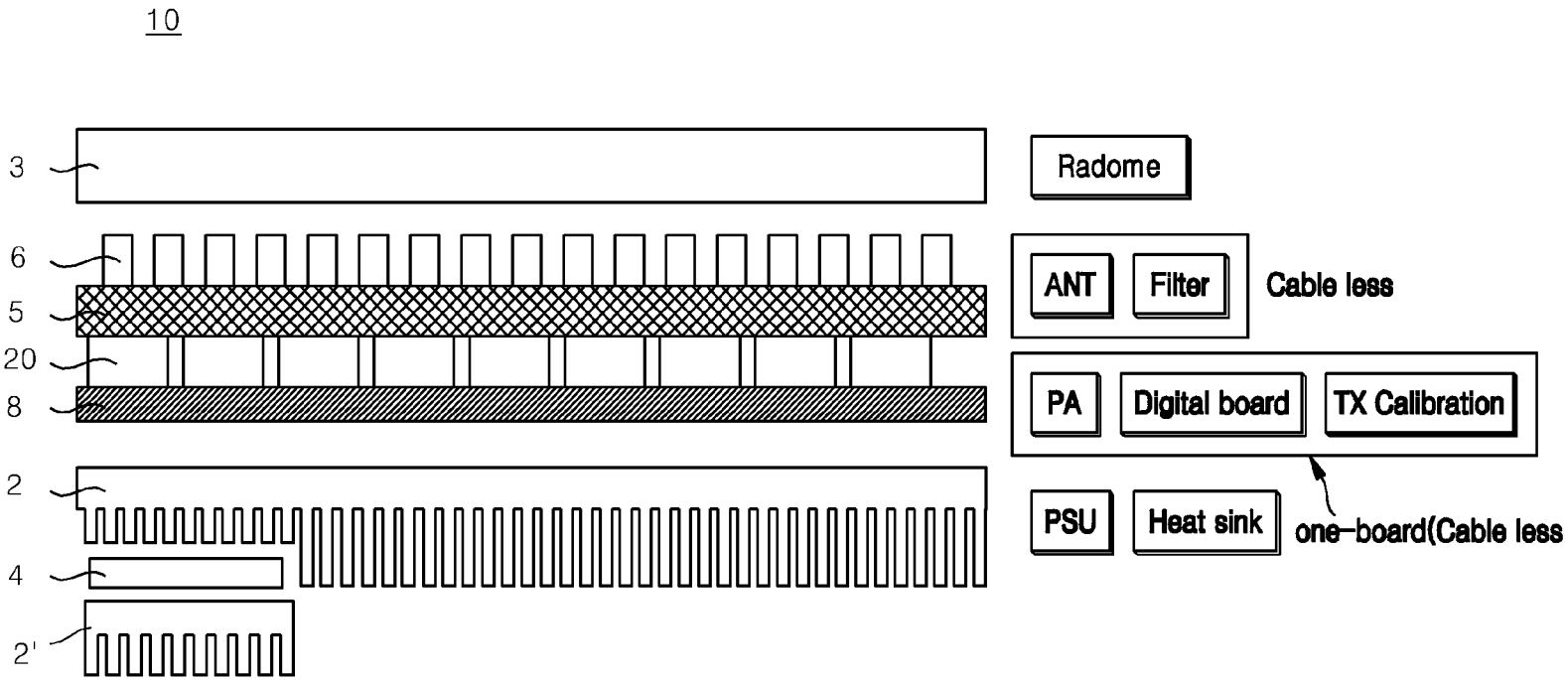
FIG. 2 is a cross-sectional view illustrating that a cavity filter in accordance with an embodiment of the present disclosure is stacked between an antenna board and a control board.

FIG. 2 is a cross-sectional view illustrating that a cavity filter in accordance with an embodiment of the present disclosure is stacked between an antenna board and a control board.

Referring to FIG. 2, a cavity filter 20 in accordance with the embodiment of the present disclosure may exclude a typical RF connector 90 illustrated in FIG. 1, which makes it possible to provide an antenna structure having a lower height profile while facilitating connection.

Furthermore, an RF connecting portion is disposed on either surface of the cavity filter 20 in the height direction thereof, and connected to the cavity filter 20 in accordance with the embodiment of the present disclosure. Although an antenna board 5 or a PCB board 8 is vibrated or thermally deformed, the RF connection is equally maintained without a change in frequency characteristic.

Figure 3:
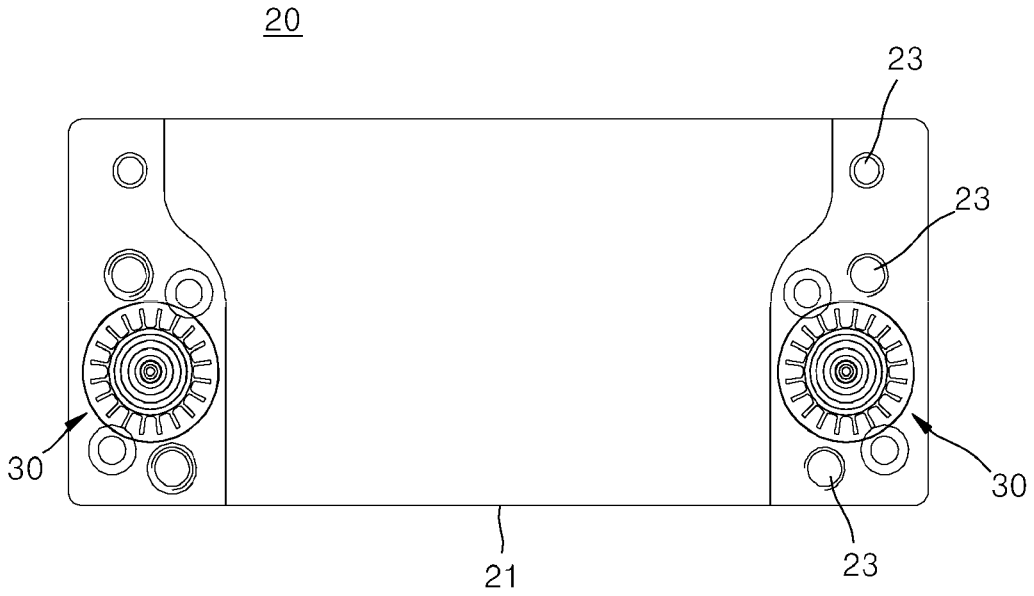
FIG. 3 is a plan perspective view of the structure of the cavity filter in accordance with the embodiment of the present disclosure, when seen from the bottom.

FIG. 3 is a plan perspective view of the structure of the cavity filter in accordance with the embodiment of the present disclosure, when seen from the bottom.

Referring to FIG. 3, the cavity filter 20 in accordance with the embodiment of the present disclosure includes an RF signal connecting portion 31 (see reference numeral 31 of FIG. 4 and the following drawings), a first case (with no reference numeral) having a hollow space therein, a second case (with no reference numeral) covering the first case, a terminal portion (see reference numeral 40 of FIG. 4) formed on either side of the first case in the longitudinal direction thereof and disposed in the height direction of the cavity filter 20, and a filter module 30 including assembly holes 23 formed on both sides of the terminal portion 40. The terminal portion 40 electrically connects an electrode pad (with no reference numeral) of the outer member 8 to the RF signal connecting portion 31 through a terminal insertion port 25 formed in the first case, the outer member 8 being configured as any one of an antenna board and a PCB board.

When the bottom of the terminal portion 40 in the drawings is supported by the RF signal connecting portion 31, and the outer member 8 configured as any one of an antenna board and a PCB board is closely coupled to the top of the terminal portion 40, the terminal portion 40 may be always contacted with the electrode pad formed on one surface of the outer member 8 configured as any one of an antenna board and a PCB board, thereby removing assembly tolerance existing in the terminal insertion port 25.

In the cavity filter 20 in accordance with the embodiment of the present disclosure, the terminal portion may be provided in an integrated type. When the terminal portion 40 is provided in an integrated type, the terminal portion 40 may be provided as an elastic body whose part is elastically deformed by a predetermined assembly force supplied by an assembler, in order to absorb the above-described assembly tolerance. However, the integrated filter having the terminal portion 40 integrated therewith does not require a separate shape design for applying lateral tension, because it is not predicted that an electric flow from one end to the other end thereof will be disconnected.

In the embodiment of the present disclosure, however, the terminal portion 40 does not necessarily need to be provided as one body, but may be provided as a separable filter which can be divided into two members. As such, when the terminal portion 40 is provided as a separable filter separated into two members, a separate elastic member 80 may be provided to absorb the assembly tolerance. Specifically, the whole length of the terminal portion 40 may be decreased while the predetermined assembly force moves a first side terminal 50 and a second side terminal 60, which are separated from each other, to overlap each other, and increased and restored to the original state when the assembly force is removed. However, since the first side terminal 50 and the second side terminal 60 of the terminal portion 40 are separated from each other, it is feared that an electric flow will be disconnected when the first side terminal 50 and the second side terminal 60 are moved to overlap each other. Therefore, any one of the first side terminal 50 and the second side terminal 60 may be provided as an elastic body, or a separate shape change for applying lateral tension may be essentially required.

The term 'lateral tension' may be defined as a force which any one of the first side terminal 50 and the second side terminal 60 transfers to the other in a direction different from the longitudinal direction, in order to prevent the disconnection of the electric flow between the first side terminal 50 and the second side terminal 60, as described above.

The antenna device is characterized in that, when the shape change of the terminal portion 40 is designed, impedance matching design in the terminal insertion port 25 needs to be paralleled. However, the embodiments of the cavity filter 20 in accordance with the present disclosure will be described under the supposition that impedance matching is achieved in the terminal insertion port 25. Therefore, among the components of the embodiments of the cavity filter in accordance with the present disclosure, which will be described with reference to FIG. 4 and the following drawings, a reinforcement plate or dielectric body inserted into the terminal insertion port 25 with the terminal portion 40 may have a different exterior shape depending on impedance matching design.

Figure 4:
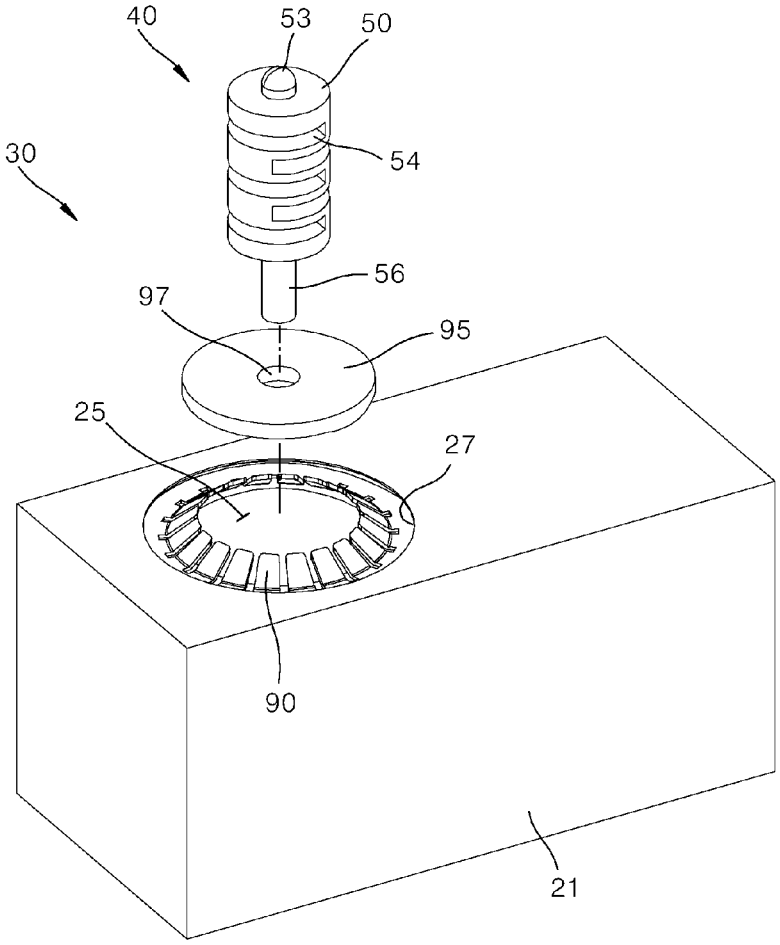
FIG. 4 is an exploded perspective view illustrating some components of a cavity filter in accordance with a first embodiment of the present disclosure.
Figure 5:
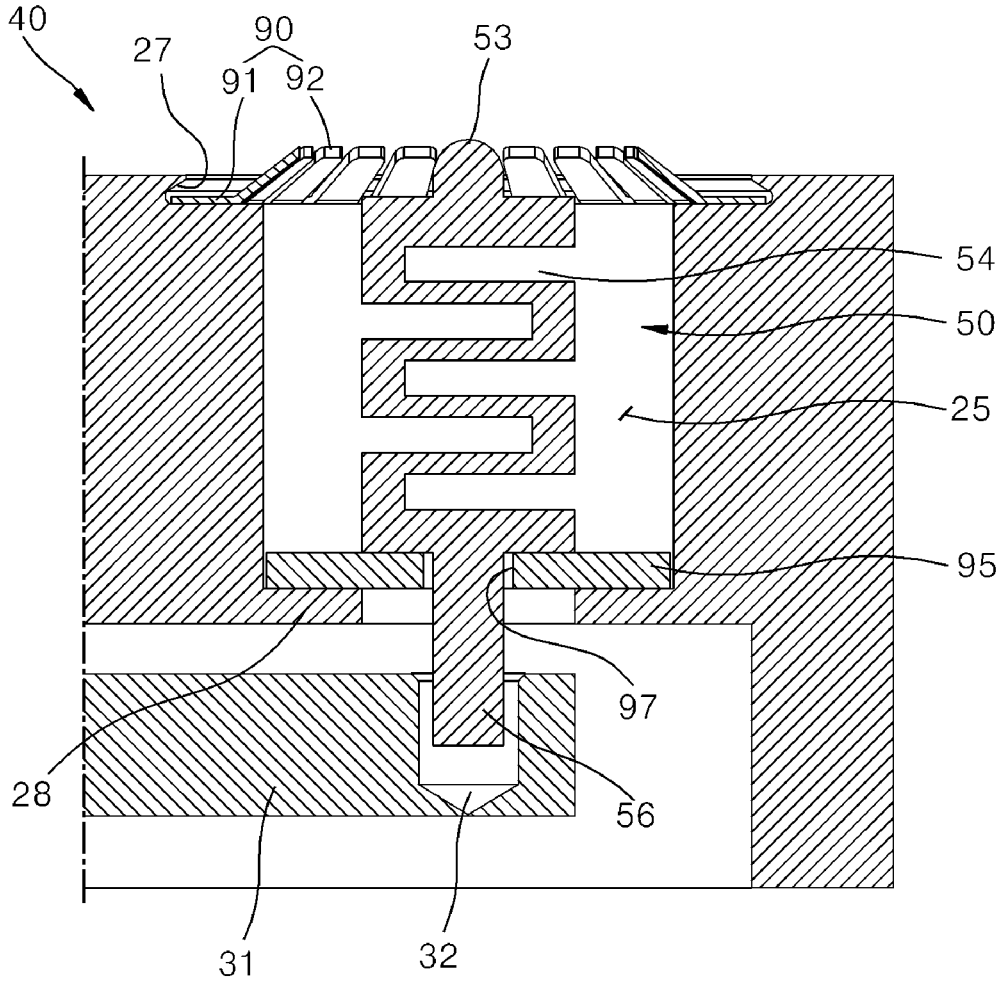
FIG. 5 is a cross-sectional view illustrating the cavity filter in accordance with the first embodiment of the present disclosure.
Figure 6:
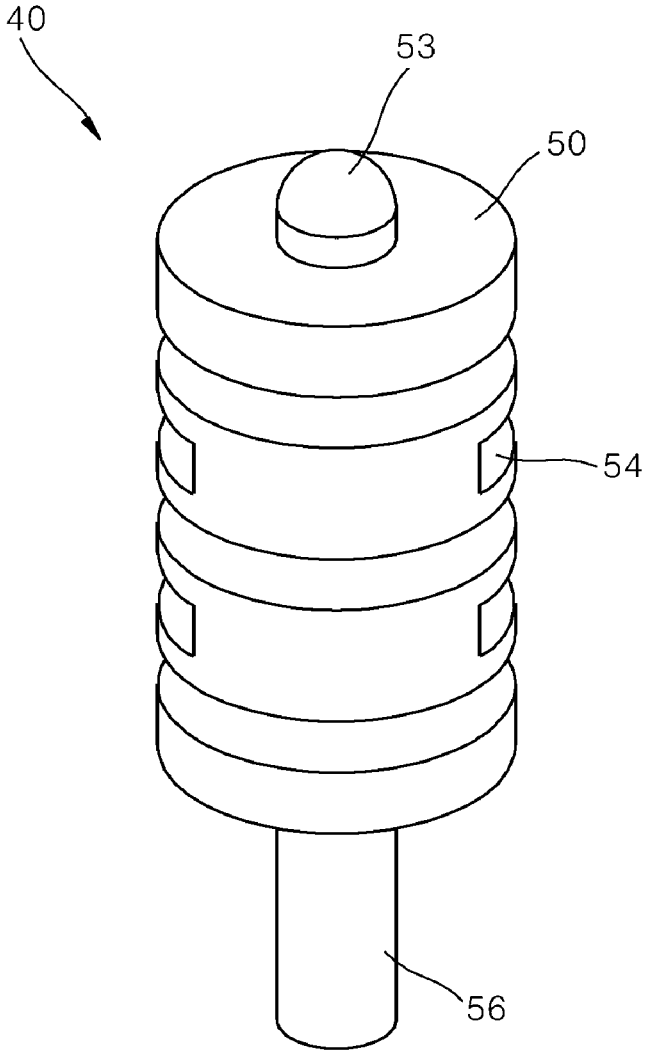
FIG. 6 is a perspective view illustrating a terminal portion among the components of FIG. 4.

FIG. 4 is an exploded perspective view illustrating some components of a cavity filter in accordance with a first embodiment of the present disclosure, FIG. 5 is a cross-sectional view illustrating the cavity filter in accordance with the first embodiment of the present disclosure, and FIG. 6 is a perspective view illustrating a terminal portion among components of FIG. 4.

As illustrated in FIGS. 4 to 6, the cavity filter 20 in accordance with the first embodiment of the present disclosure includes an RF signal connecting portion 31 and a terminal portion 40. The RF signal connecting portion 31 is spaced part, by a predetermined distance, from a surface of an outer member 8, or specifically an electrode pad (with no reference numeral). The terminal portion 40 may electrically connect the electrode pad of the outer member 8 to the RF signal connecting portion 31, and not only absorb assembly tolerance at the predetermined distance, but also prevent disconnection of the electric flow between the electrode pad and the RF signal connecting portion 31.

As illustrated in FIG. 2, the outer member 8 may be commonly referred to as any one of an antenna board having antenna elements arranged on the other surface thereof and a PCB board provided as one board on which a PA (Power Amplifier), a digital board and TX calibration are integrated.

Hereafter, as illustrated in FIG. 3, an exterior configuration constituting the embodiments of the cavity filter 20 in accordance with the present disclosure is not divided into first and second cases, but commonly referred to as a filter body 21 having the terminal insertion port 25 formed therein.

As illustrated in FIGS. 4 and 5, the terminal insertion port 25 of the filter body 21 may be provided as a hollow space. The terminal insertion port 25 may be formed in different shapes depending on impedance matching design applied to a plurality of embodiments which will be described below.

The filter body 21 may have a washer installation portion 27 formed as a groove on one surface thereof, on which the first side terminal 50 of the terminal portion 40 to be described below is provided. The washer installation portion 27 may be formed as a groove to have a larger inner diameter than the terminal insertion port 25. Thus, when the outer edge of a star washer 90 which will be described below is locked to the washer installation portion 27, the star washer 90 may be prevented from being separated upward.

Furthermore, the cavity filter 20 in accordance with the first embodiment of the present disclosure may further include the star washer 90 fixedly installed on the washer installation portion 27.

The following descriptions are based on the supposition that the star washer 90 is commonly provided in all the embodiments of the present disclosure, which will be described below, as well as the first embodiment of the present disclosure. Therefore, it should be understood that, although the star washer 90 is not described in detail in the embodiments other than the first embodiment, the star washer 90 is included in the embodiments.

The star washer 90 may includes a fixed edge 91 formed in a ring shape and fixed to the washer installation portion 27, and a plurality of support pieces 92 which are upwardly inclined from the fixed edge 91 toward the center of the electrode pad of the outer member 8 configured as any one of an antenna board and a PCB board.

When the embodiments of the cavity filter 20 in accordance with the present disclosure are assembled to the outer member 8 configured as any one of an antenna board and a PCB board by an assembler, the star washer 90 may apply an elastic force to a fastening force by a fastening member (not illustrated) through the above-described assembly hole, while the plurality of support pieces 92 are supported on one surface of the outer member 8 configured as any one of an antenna board and a PCB board.

The applying of the elastic force through the plurality of support pieces 92 may make it possible to uniformly maintain a contact area with the electrode pad of the terminal portion 40.

Furthermore, the ring-shaped fixed edge 91 of the star washer 90 may be provided to cover the outside of the terminal portion 40 which is provided to transfer an electric signal, and serve as a kind of ground terminal.

Furthermore, the star washer 90 serves to absorb assembly tolerance existing between the outer members 8 each provided as any one of an antenna board and a PCB board in the embodiments of the cavity filter 20 in accordance with the present disclosure.

As described below, however, the assembly tolerance absorbed by the star washer 90 exists in the terminal insertion port 25, and is distinguished from assembly tolerance absorbed by the terminal portion 40. That is, the cavity filter in accordance with the embodiments of the present disclosure may be designed to absorb overall assembly tolerances at two or more locations through separate members during a single assembly process, and thus coupled more stably.

As illustrated in FIGS. 4 to 6, the terminal portion in the cavity filter 20 in accordance with the first embodiment of the present disclosure may be disposed between the RF signal connecting portion 31 and the electrode pad of the outer member 8 configured as any one of an antenna board and a PCB board, and all or partially deformed when an assembly force of an assembler is provided, thereby absorbing assembly tolerance existing in the terminal insertion port 25.

In the cavity filter 20 in accordance with the first embodiment of the present disclosure, the terminal portion 40 may be made of a conductive material and provided as a single terminal portion, and include an elastic deformation portion 54 which is deformed by the assembly force as described above.

As technical components for absorbing assembly tolerance existing in the terminal insertion port 25, two or more terminal portions 40 may be provided, and terminals constituting each of the terminal portions 40 may be moved by an assembly force so as to overlap each other. For example, each of the terminal portions 40 may be divided into two terminals, i.e. the first side terminal and the second side terminal. The cavity filter 20 in accordance with the first embodiment of the present disclosure may adopt a structure in which the terminal portion 40 is provided as a single terminal portion, and some of the terminal portions are deformed by an assembly force.

When the terminal portion 40 is provided as a single terminal portion, it is not predicted that disconnection of an electric flow will occur unlike the structure in which the terminal portion 40 is divided into two or more terminals. Thus, separate tension cut portions for applying lateral tension between the two or more terminals do not need to be provided.

However, when the terminal portion 40 is adopted as a single terminal portion, the terminal portion 40 may have the elastic deformation portion 54 which can be expanded/contracted in the longitudinal direction thereof, in order to absorb assembly tolerance existing in the terminal insertion port 25 as described above.

In the cavity filter 20 in accordance with the first embodiment of the present disclosure, the terminal portion may include the plurality of elastic deformation portions 54 formed by partially chamfering the outer circumferential surface of the terminal portion 40 as illustrated in FIGS. 4 to 6. Thus, the distance between the top and bottom of the terminal portion 40 may be increased/decreased by an assembly force transferred in a top-to-bottom direction.

The plurality of elastic deformation portions 54 are formed by partially chamfering the outer circumferential surface of the terminal portion 40 from one side to the opposite side thereof by a predetermined height. The plurality of elastic deformation portions 54 may be formed in the top-to-bottom direction, and the neighboring elastic deformation portions 54 may be chamfered in the opposite directions to each other. Furthermore, the chamfered parts of the neighboring elastic deformation portions 54 may be formed to partially overlap each other.

Therefore, when a contact portion 53 as an upper end portion of the terminal portion 40 is pressed by an assembly force of an assembler, the chamfered entrances of the elastic deformation portions 54 may be deformed close to each other, like stacked plate springs, thereby absorbing assembly tolerance existing in the terminal insertion port 25.

As illustrated in FIGS. 4 to 6, the cavity filter 20 in accordance with the first embodiment of the present disclosure may further include a reinforcement plate 95 disposed in the terminal insertion port 25 so as to support a lower end portion 56 of the terminal portion 40, which is disposed through the reinforcement plate 95.

The reinforcement plate 95 may have a terminal through-hole 97 through which the lower end portion 56 of the terminal portion 40 passes. The bottom surface of the edge of the reinforcement plate 95 may be supported by an insertion slot support portion 28 provided in the terminal insertion port 25.

The reinforcement plate 95 supports the lower end portion of the terminal portion 40 and thus restricts the terminal portion 40 from being excessively moved downward by an assembly force provided by an assembler. As a result, the reinforcement plate 95 serves to reinforce the RF signal connecting portion 31.

As such, the terminal portion 40 provided as a single terminal portion in the cavity filter 20 in accordance with the first embodiment of the present disclosure may prevent disconnection of an electric flow, and be expanded/contracted in the terminal insertion port 25 by an assembly force, thereby absorbing assembly tolerance existing in the terminal insertion port 25.

However, when the terminal portion 40 itself can be expanded/contracted in the terminal insertion port 25, the terminal portion 40 is not limited to a single terminal portion. In some embodiments, the terminal portion 40 may be divided into first side terminal contacted with the electrode pad and the second side terminal fixed to the RF signal connecting portion 31. In this case, only any one of the two terminals may be self-expanded/contracted by expected assembly tolerance. This structure will be described in detail with reference to the following embodiments.

Figure 7:
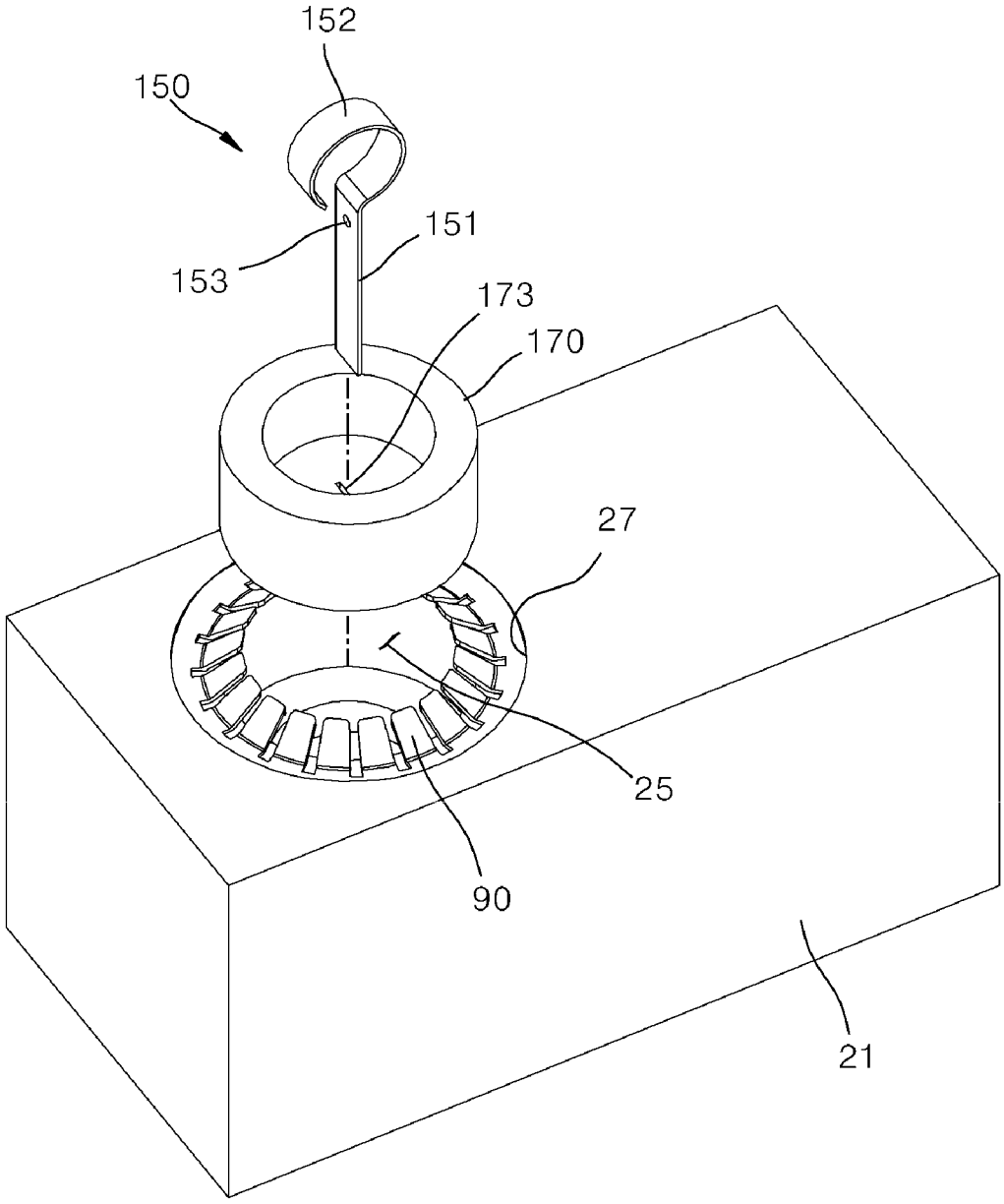
FIG. 7 is an exploded perspective view illustrating a cavity filter in accordance with a second embodiment of the present disclosure.
Figure 8:
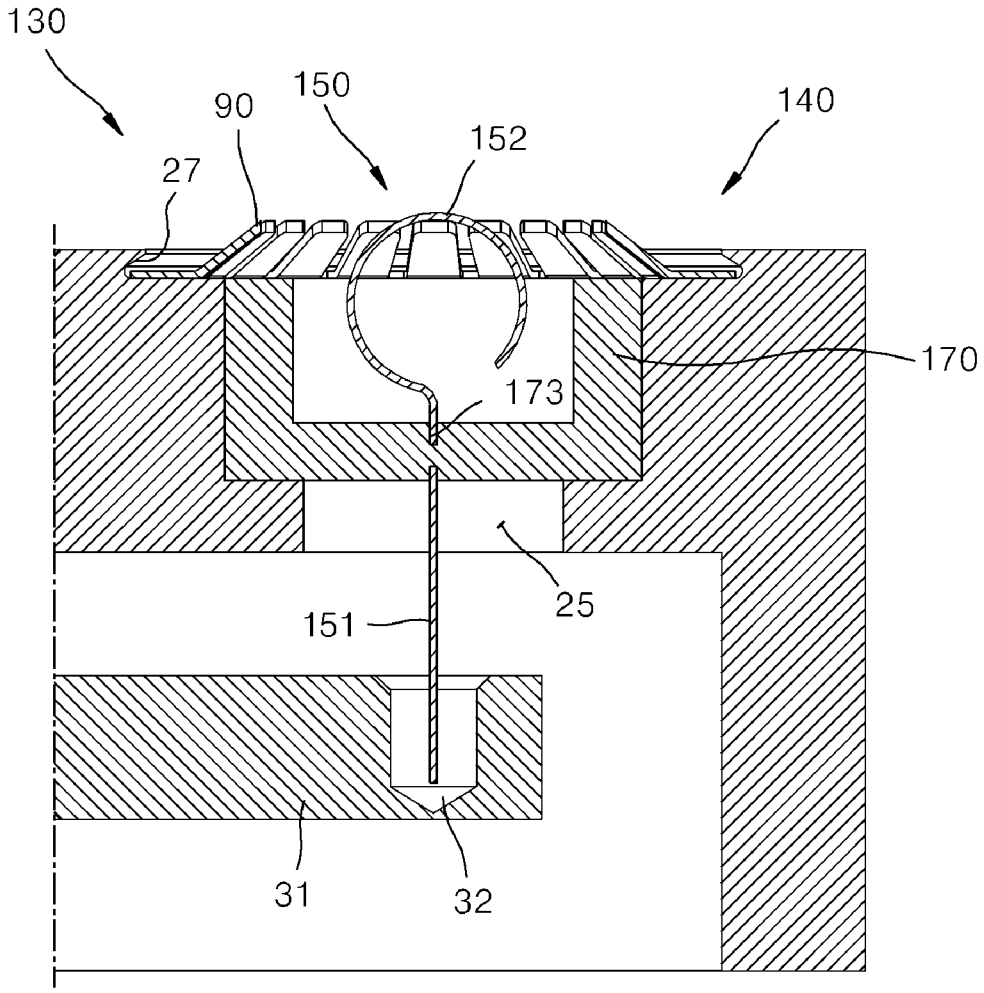
FIG. 8 is a cross-sectional view illustrating the cavity filter in accordance with the second embodiment of the present disclosure.
Figure 9:
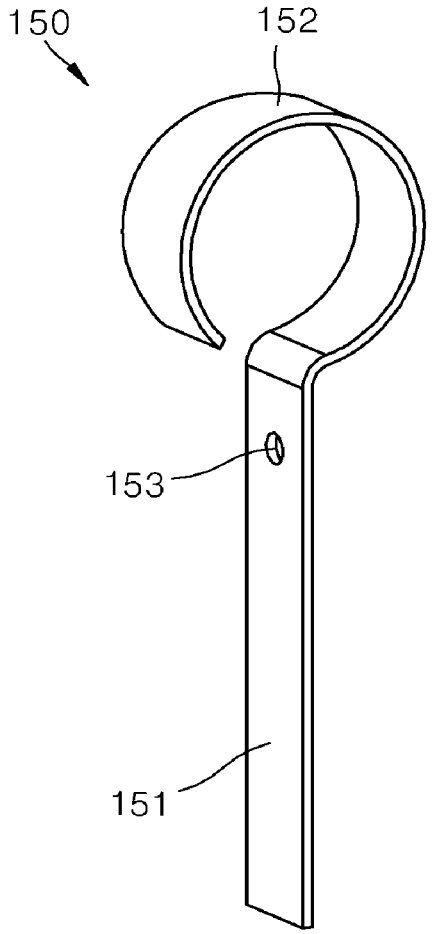
FIG. 9 is a perspective view illustrating a terminal portion among components of FIG. 7.

FIG. 7 is an exploded perspective view illustrating some components of a cavity filter in accordance with a second embodiment of the present disclosure, FIG. 8 is a cross-sectional view illustrating that a terminal portion is inserted and installed into a terminal insertion port among components of FIG. 7, and FIG. 9 is a perspective view illustrating the terminal portion among the components of FIG. 7.

As illustrated in FIGS. 7 to 9, a cavity filter 20 in accordance with the second embodiment of the present disclosure may include a terminal portion 150 having a round contact portion 152 and a vertical connection portion 151, compared to the cavity filter 20 in accordance with the first embodiment. The round contact portion 152 may be formed in a round shape so as to be contacted with an electrode pad of an outer member 8 configured as any one of an antenna board and a PCB board, and the vertical connection portion 151 may be extended downward right from the round contact portion 152 and soldered and fixed to a solder hole 32 formed in a plate extended from an RF signal connecting portion 31.

The round contact portion 152 may be rounded to have a cross-sectional shape similar to the cross-sectional shape of an upper portion of a question mark which is a symbolic character.

Furthermore, a dielectric body 170 for impedance matching design may be inserted into the terminal insertion port 25, and have a terminal through-hole 173 through which the vertical connection portion 151 passes.

In the cavity filter 20 in accordance with the second embodiment of the present disclosure, when an assembly force of an assembler is provided to the terminal portion 150, a leading end of the round contact portion 152 corresponding to an elastic deformation portion may be pressed downward and elastically deformed to absorb assembly tolerance existing in the terminal insertion port 25.

Figure 10:
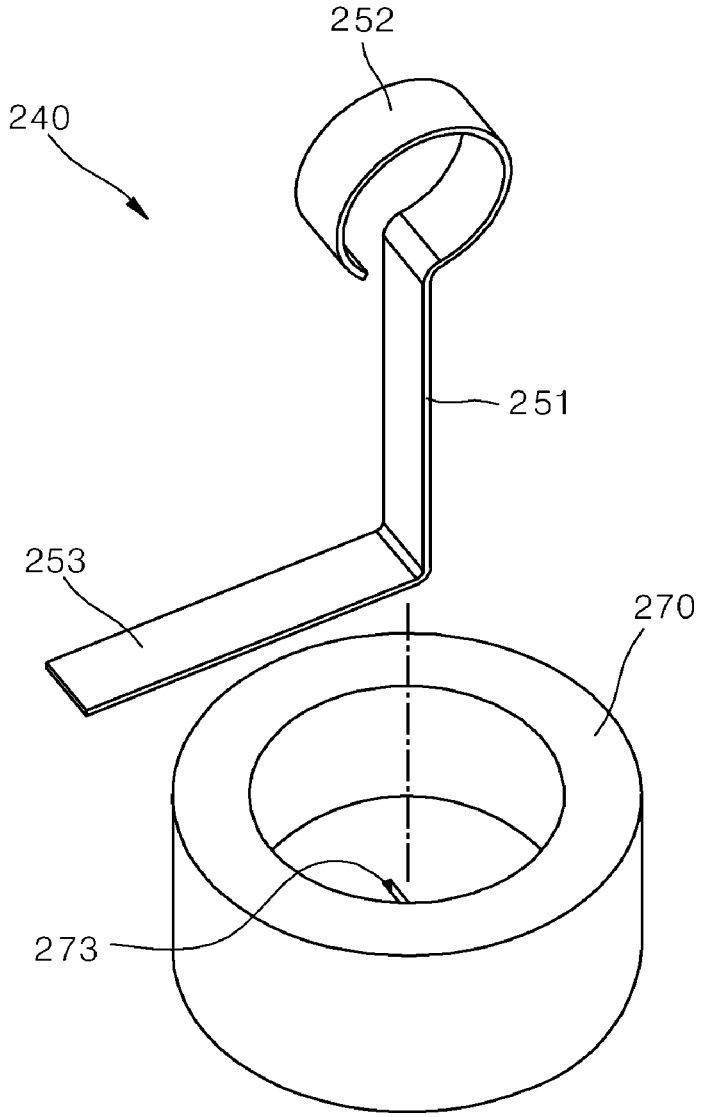
FIG. 10 is an exploded perspective view illustrating a cavity filter in accordance with a third embodiment of the present disclosure.
Figure 11:
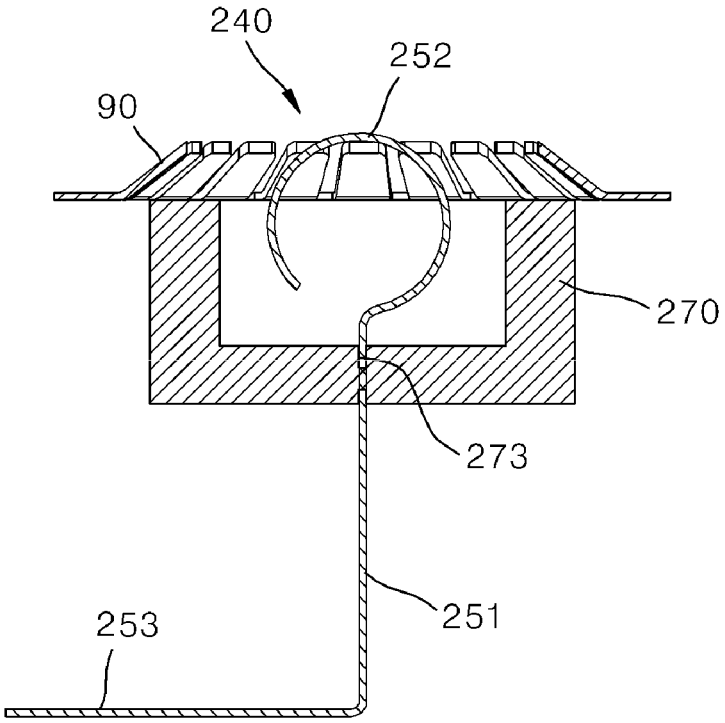
FIG. 11 is a cross-sectional view illustrating the cavity filter in accordance with the third embodiment of the present disclosure.
Figure 12:
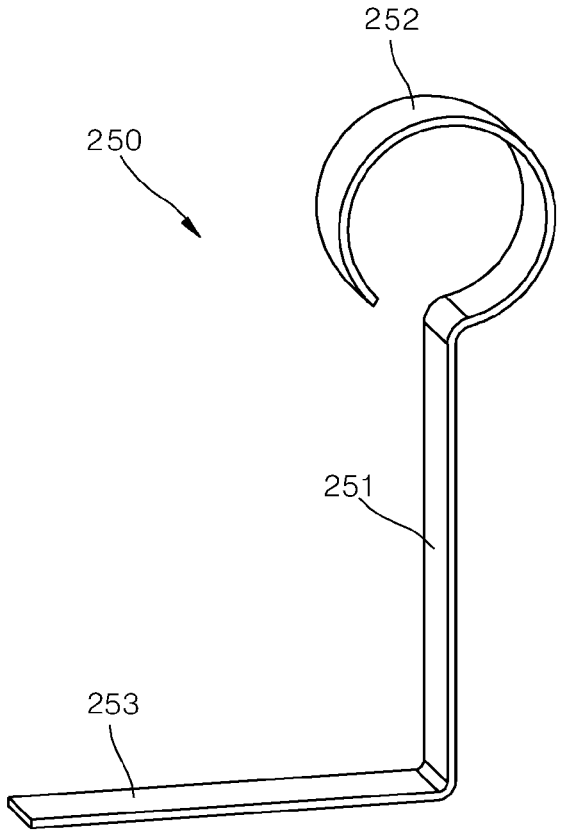
FIG. 12 is a perspective view illustrating a terminal portion among components of FIG. 10.

FIG. 10 is an exploded perspective view illustrating some components of a cavity filter in accordance with a third embodiment of the present disclosure, FIG. 11 is a cross-sectional view illustrating that a terminal portion is inserted and installed into a terminal insertion port among the components of FIG. 10, and FIG. 12 is a perspective view illustrating the terminal portion among the components of FIG. 10.

As illustrated in FIGS. 10 to 12, a cavity filter 20 in accordance with the third embodiment of the present disclosure may include a terminal portion 240 having a round contact portion 252, a connection terminal portion 251 and a bent connection portion 253. The round contact portion 252 may be formed in a round shape so as to be contacted with an electrode pad of an outer member 8 configured as any one of an antenna board and a PCB board. The connection terminal portion 251 may be extended downward right from the round contact portion 252. The bent connection portion 253 may be bent and extended from the bottom of the connection terminal portion 251 toward an RF signal connecting portion (with no reference numeral) provided on one side right under a terminal insertion port 25. In this case, a separate plate extended horizontally from the RF signal connecting portion may be omitted.

The round contact portion 252 may be formed in a round shape to have a cross-sectional shape similar to the cross-sectional shape of an upper portion of a question mark, and the connection terminal portion 251 and the bent connection portion 253 may be bent to have an L-shaped cross-section whose lower end portion is bent substantially perpendicular to the upper end portion thereof.

Furthermore, a dielectric body 270 for impedance matching design may be inserted into the terminal insertion port 25, and have a terminal through-hole 273 through which the connection terminal portion 251 passes.

In the cavity filter 20 in accordance with the third embodiment of the present disclosure, when an assembly force of an assembler is provided to the terminal portion 240, a leading end of the round contact portion 252 corresponding to an elastic deformation portion may be pressed downward and elastically deformed to absorb assembly tolerance existing in the terminal insertion port 25.

Figure 13:
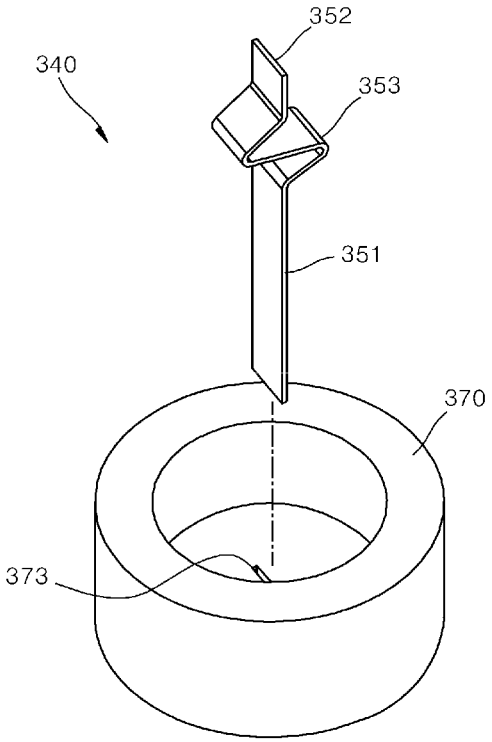
FIG. 13 is an exploded perspective view illustrating a cavity filter in accordance with a fourth embodiment of the present disclosure.
Figure 14:
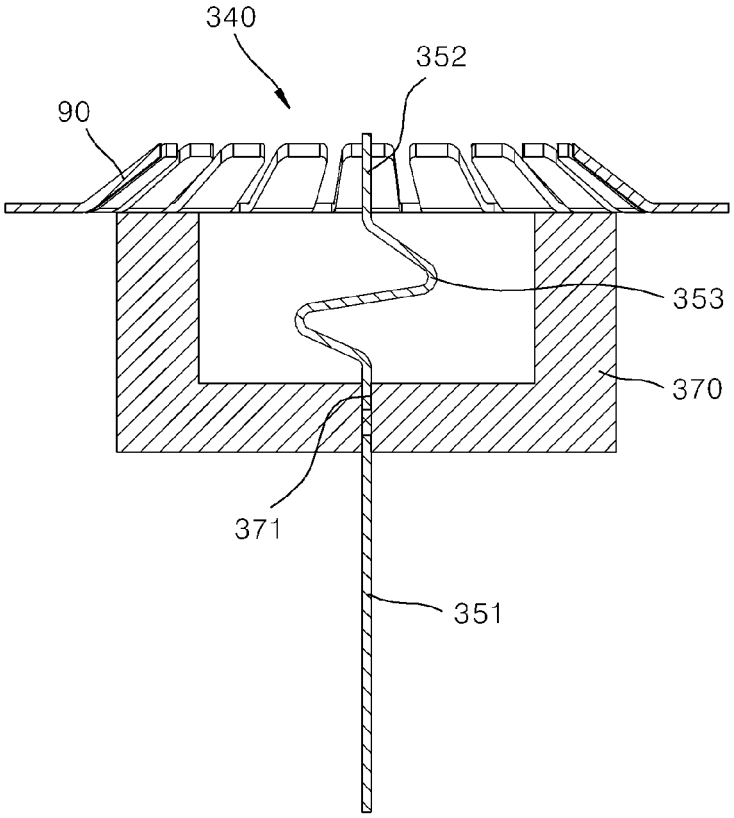
FIG. 14 is a cross-sectional view illustrating the cavity filter in accordance with the fourth embodiment of the present disclosure.
Figure 15:
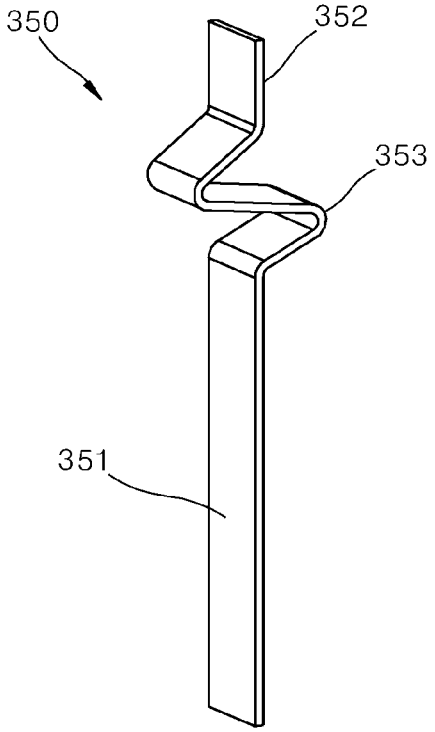
FIG. 15 is a perspective view illustrating a terminal portion among components of FIG. 13.

FIG. 13 is an exploded perspective view illustrating some components of a cavity filter in accordance with a fourth embodiment of the present disclosure, FIG. 14 is a cross-sectional view illustrating that a terminal portion is inserted and installed into a terminal insertion port among the components of FIG. 13, and FIG. 15 is a perspective view illustrating the terminal portion among the components of FIG. 13.

As illustrated in FIGS. 13 to 15, a cavity filter 20 in accordance with the fourth embodiment of the present disclosure may include a terminal portion 340 having a vertical contact portion 352, a vertical connection portion 351 and a bent portion 353. The vertical contact portion 352 may be vertically formed so as to be contacted with an electrode pad of an outer member 8 configured as any one of an antenna board and a PCB board. The vertical connection portion 351 may be formed as one body with the vertical contact portion 352, and soldered and fixed to a solder hole 32 formed in a portion extended in a plate shape as an RF signal connecting portion 31. The bent portion 353 may be bent in a zigzag shape between the vertical connection portion 351 and the vertical contact portion 352.

In the cavity filter 20 in accordance with the fourth embodiment of the present disclosure, when an assembly force of an assembler is provided to the terminal portion 340, the bent portion 353 corresponding to an elastic deformation portion may be folded in the top-to-bottom direction and elastically deformed to absorb assembly tolerance existing in the terminal insertion port 25.

In addition, a dielectric body 370 having a terminal through-hole 371 formed therein and the other components are provided in the same manner as or similar manner to those of the cavity filter 20 in accordance with the third embodiment. Thus, the detailed descriptions thereof will be omitted herein.

Figure 16:
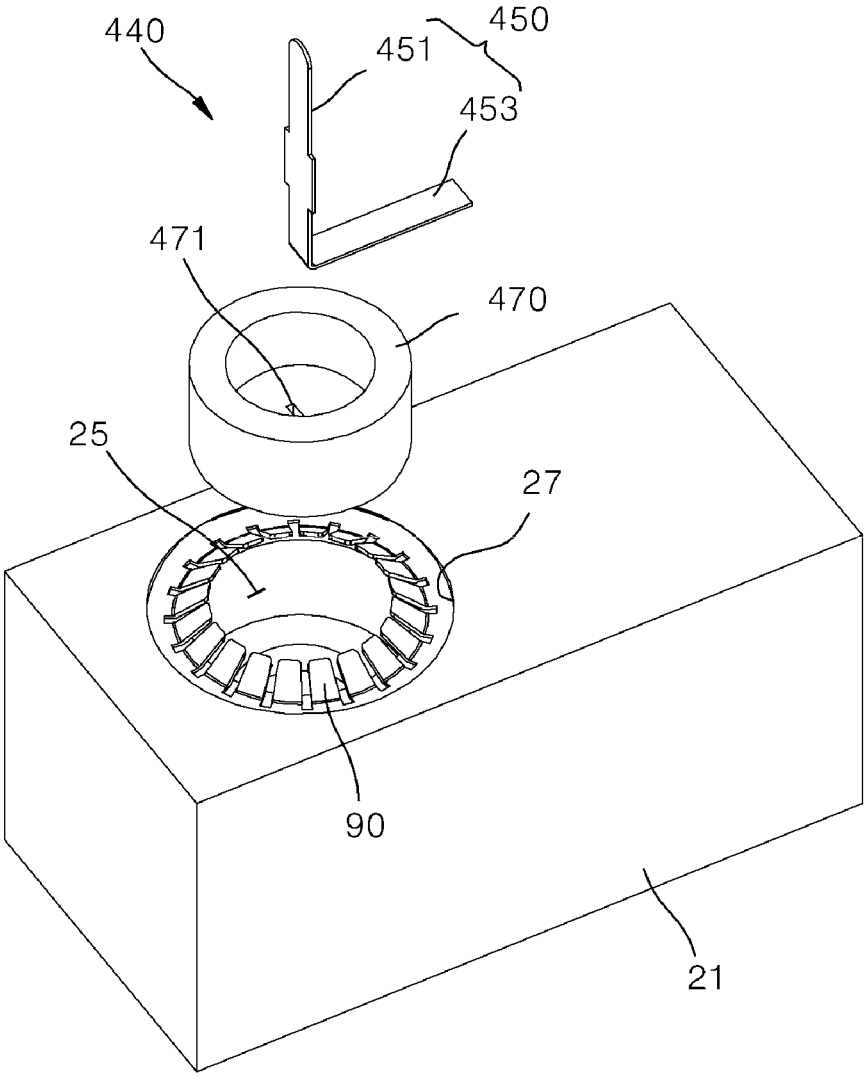
FIG. 16 is an exploded perspective view illustrating a cavity filter in accordance with a fifth embodiment of the present disclosure.
Figure 17:
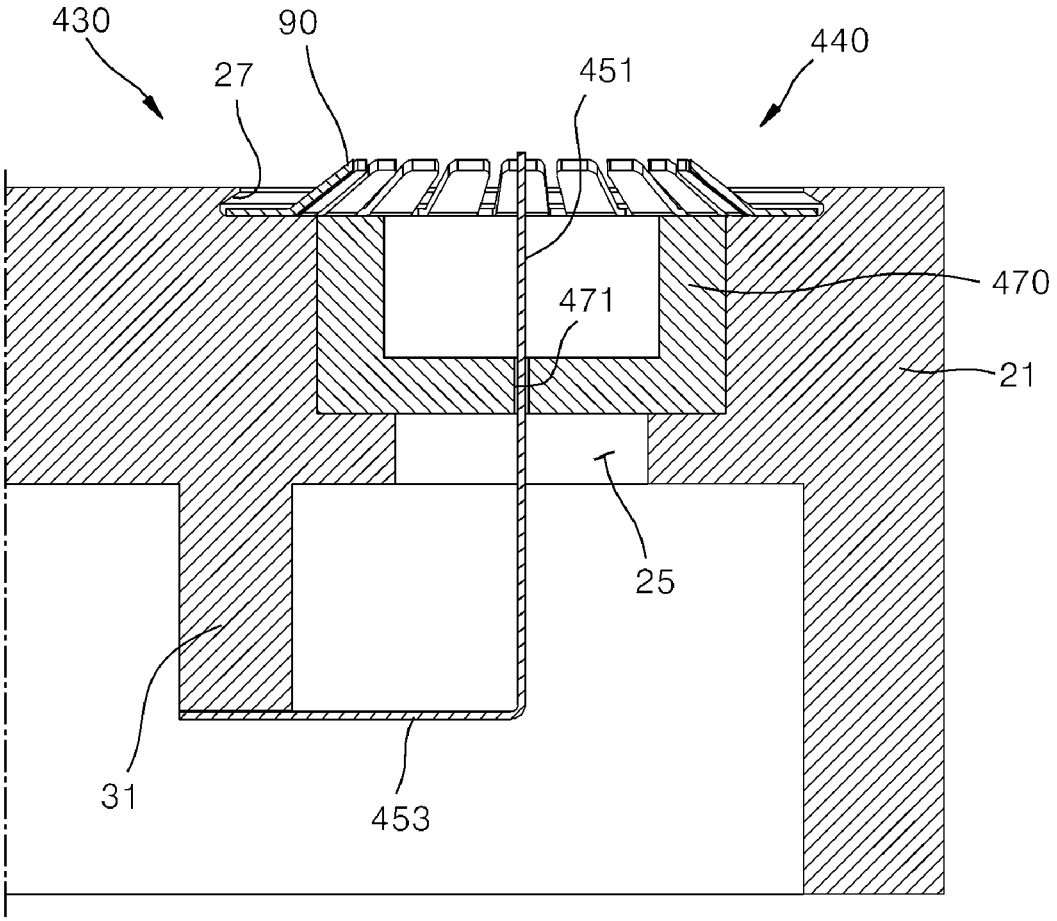
FIG. 17 is a cross-sectional view illustrating the cavity filter in accordance with the fifth embodiment of the present disclosure.
Figure 18:
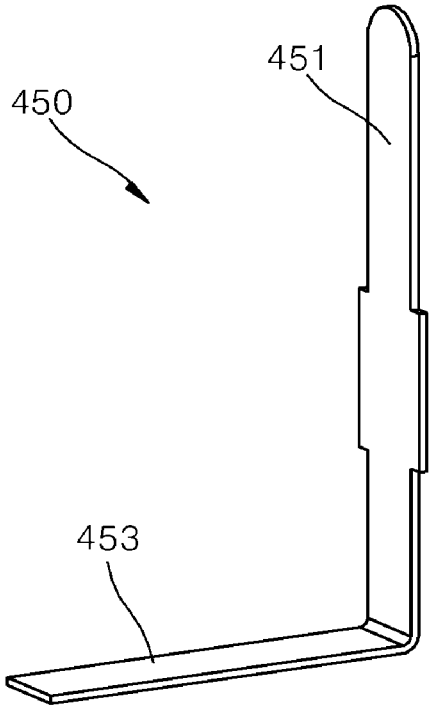
FIG. 18 is a perspective view illustrating a terminal portion among components of FIG. 16.

FIG. 16 is an exploded perspective view illustrating some components of a cavity filter in accordance with a fifth embodiment of the present disclosure, FIG. 17 is a cross-sectional view illustrating that a terminal portion is inserted and installed into a terminal insertion port among the components of FIG. 16, and FIG. 18 is a perspective view illustrating the terminal portion among the components of FIG. 16.

As illustrated in FIGS. 16 to 18, a cavity filter 20 in accordance with the fifth embodiment of the present disclosure may include a terminal portion 440 having a vertical contact portion 451 and a horizontal connection portion 453. The vertical contact portion 451 may be vertically formed so as to be contacted with an electrode pad of an outer member 8 configured as any one of an antenna board and a PCB board. The horizontal connection portion 453 may be bent and extended from the bottom of the vertical contact portion 451 toward an RF signal connecting portion 31 provided on one side right under a terminal insertion port 25. Even in this case, a separate plate extended horizontally from the RF signal connecting portion 31 may be omitted.

Among the components of the terminal portion 440 of the cavity filter 20 in accordance with the fifth embodiment of the present disclosure, the vertical contact portion 451 corresponds to the vertical contact portion 352 among the components of the terminal portion 340 of the cavity filter 20 in accordance with the fourth embodiment, and the horizontal connection portion 453 corresponds to the bent connection portion 253 among the components of the terminal portion 240 of the cavity filter 20 in accordance with the third embodiment.

In the cavity filter 20 in accordance with the fifth embodiment of the present disclosure, which has the above-described configuration, the horizontal connection portion 453 may be fixed in a cantilever shape to the RF signal connecting portion 31. Thus, while a pressing force of the vertical contact portion 451 by an assembly force of an assembler acts as a kind of moment, the horizontal connection portion 453 may be elastically deformed to droop downward, thereby absorbing assembly tolerance existing in the terminal insertion port 25. Therefore, in the cavity filter 20 in accordance with the fifth embodiment, the terminal portion 440 does not include a separate elastic deformation portion which is visually formed, and the entire terminal portion 440 except the fixed point of the horizontal connection portion 453 may be elastically deformed to absorb assembly tolerance.

Figure 19:
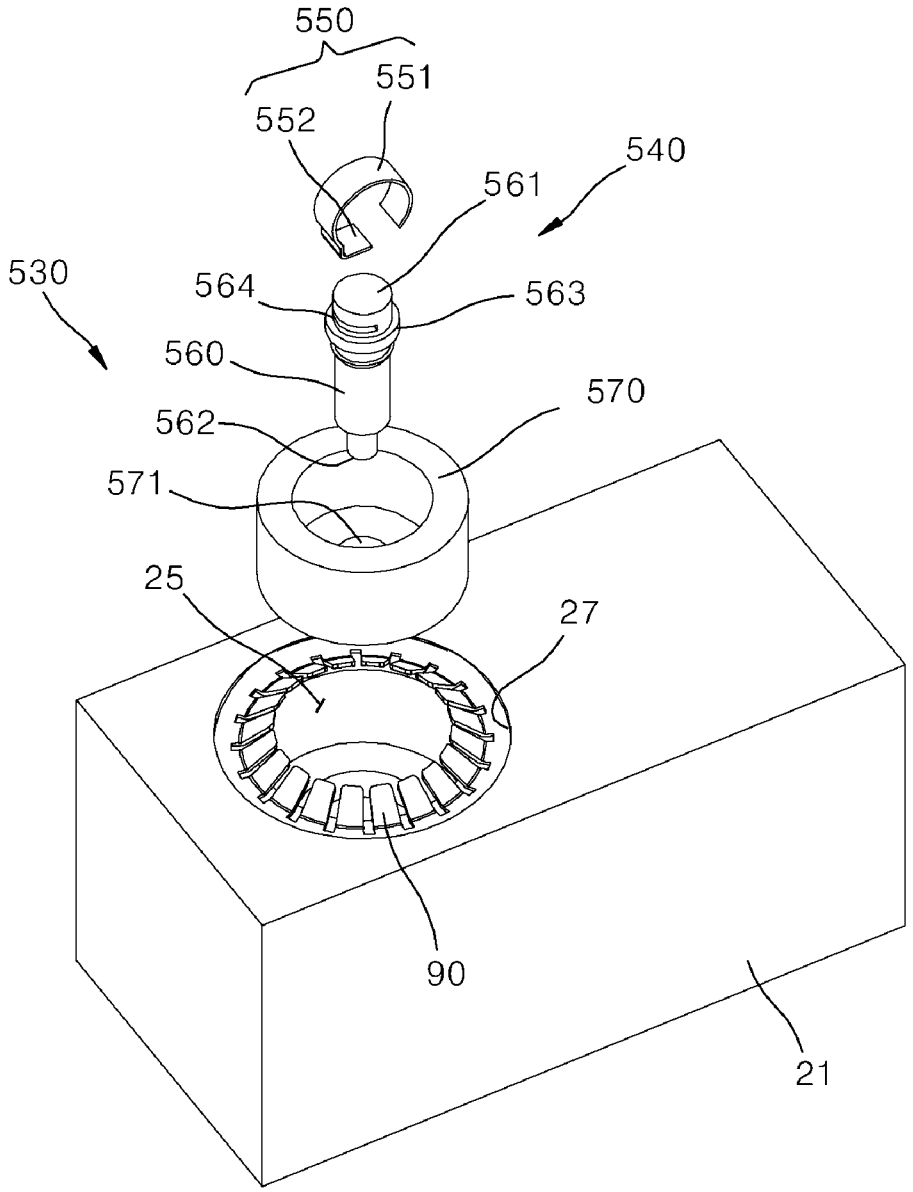
FIG. 19 is an exploded perspective view illustrating a cavity filter in accordance with a sixth embodiment of the present disclosure.
Figure 20:
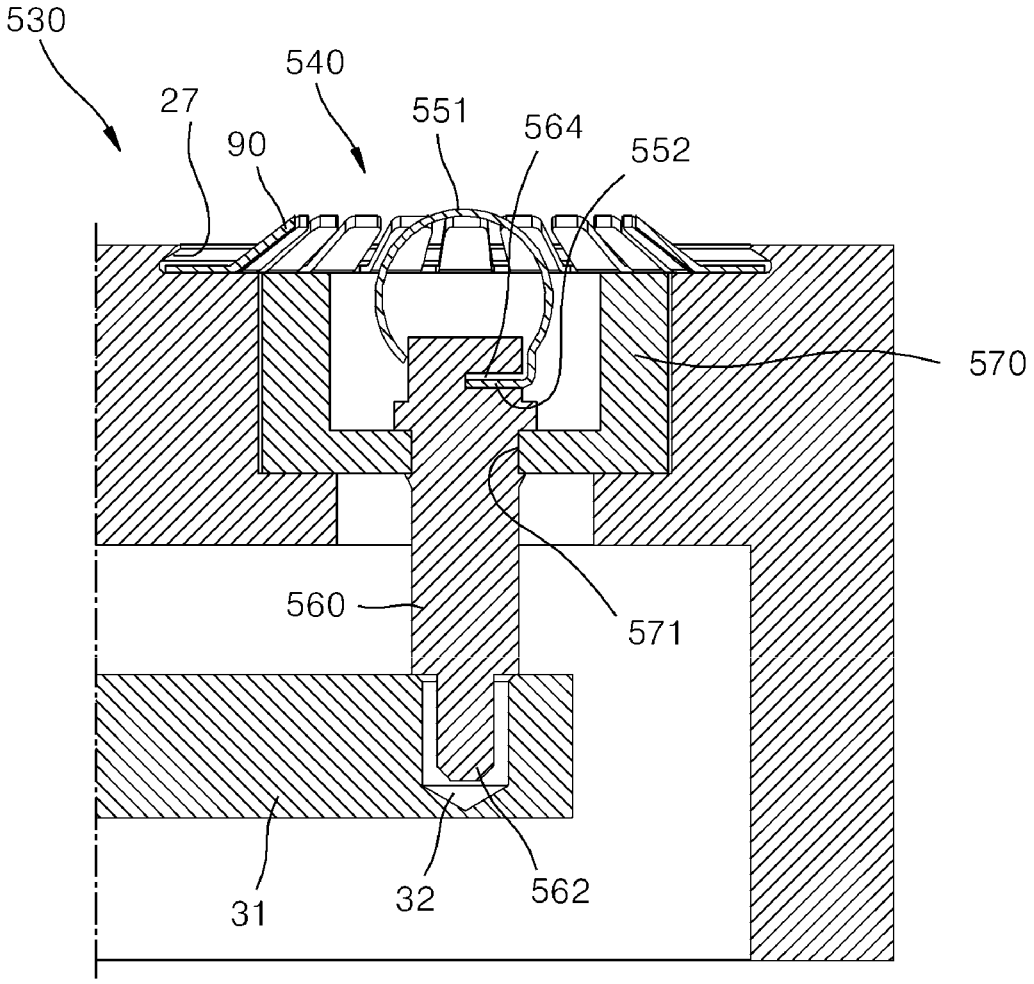
FIG. 20 is a cross-sectional view illustrating the cavity filter in accordance with the sixth embodiment of the present disclosure.
Figure 21:
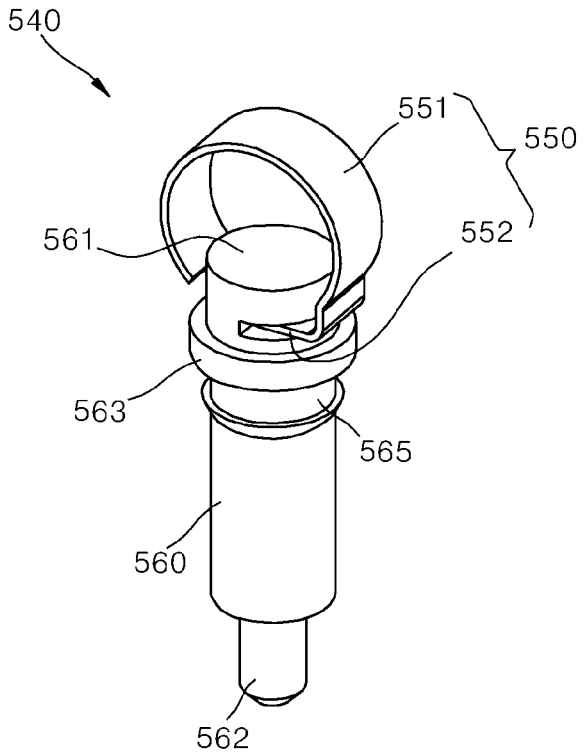
FIG. 21 is a perspective view illustrating a terminal portion among components of FIG. 19.

FIG. 19 is an exploded perspective view illustrating some components of a cavity filter in accordance with a sixth embodiment of the present disclosure, FIG. 20 is a cross-sectional view illustrating that a terminal portion is inserted and installed into a terminal insertion port among the components of FIG. 19, and FIG. 21 is a perspective view illustrating the terminal portion among the components of FIG. 19.

As illustrated in FIGS. 19 to 21, a cavity filter 20 in accordance with the sixth embodiment of the present disclosure may include a terminal portion 540 having a first side terminal 550 and a second side terminal 560. The first side terminal 550 may be elastically deformed by an assembly force provided by an assembler, and disposed at the top of a terminal insertion port 25 so as to be contacted with an electrode pad formed on an outer member 8 configured as any one of an antenna board and a PCB board. The second side terminal 560 may be disposed at the bottom of the terminal insertion port 25, and soldered and fixed to a solder hole 32 formed in a plate of an RF signal connecting portion 31.

The first side terminal 550 may include a contact portion 551 and a terminal fixing portion 552. The contact portion 551 may be formed in a round shape such that the top thereof is contacted with the electrode pad, and the terminal fixing portion 552 may be horizontally extended from the bottom of the contact portion 551, and fixed to the second side terminal 560.

The second side terminal 560 may have a fixing groove 564 formed in an upper end portion 561 thereof such that the terminal fixing portion 552 of the first side terminal 550 is inserted into the fixing groove 564, and a lower end portion 562 of the second side terminal 560 may be inserted, and soldered and fixed to the solder hole 32 formed in the plate of the RF signal connecting portion 31.

Furthermore, the second side terminal 560 may have a stop rib 563 protruding from the outer circumferential surface thereof under the fixing groove 564. The stop rib 563 may serve to prevent excessive elastic deformation in the first side terminal 550.

When an assembly force of an assembler is not provided with the terminal fixing portion 552 fixed to the fixing groove 564 of the second side terminal 560, a leading end of the contact portion 551 in the first side terminal 550 is spaced apart, by a predetermined distance, from a rib surface of the stop rib 563 in the top-to-bottom direction. Then, while the assembly force of the assembler is provided, the contact portion 551 is elastically deformed and locked to the stop rib 563.

Therefore, the distance between the rib surface of the stop rib 563 and the leading end of the contact portion 551 with no assembly force provided may be set to such an extent that assembly tolerance existing in at least the terminal insertion port 25 can be all absorbed.

As illustrated in FIGS. 19 to 20, the cavity filter 20 in accordance with the sixth embodiment of the present disclosure may further include a dielectric body 570 disposed in the terminal insertion port 25 and having a terminal through-hole 571 through which the second side terminal 560 is fixed.

In the cavity filter 20 in accordance with the sixth embodiment of the present disclosure, when an assembly force of an assembler is provided, the round contact portion 551 of the first side terminal 550, formed in a round shape as an elastic deformation portion, may be elastically deformed to absorb assembly tolerance existing in the terminal insertion port 25.

Furthermore, both of the first side terminal 550 and the second side terminal 560 are formed of a conductive material, and the terminal fixing portion 552 of the first side terminal 550 is reliably fixed to the fixing groove 564 of the second side terminal 560. Thus, separate tension cut portions for applying lateral tension are not required.

Figure 22:
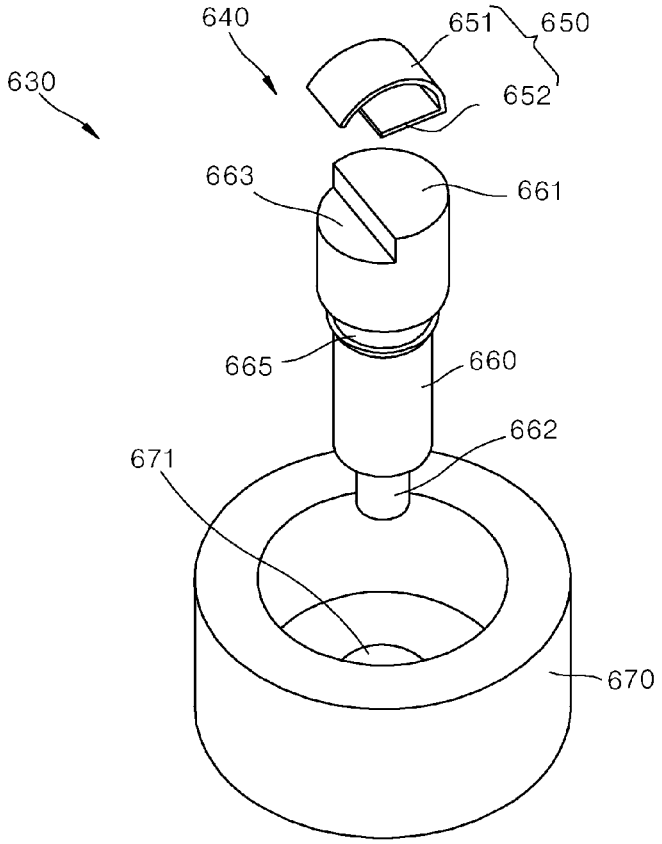
FIG. 22 is an exploded perspective view illustrating a cavity filter in accordance with a seventh embodiment of the present disclosure.
Figure 23:
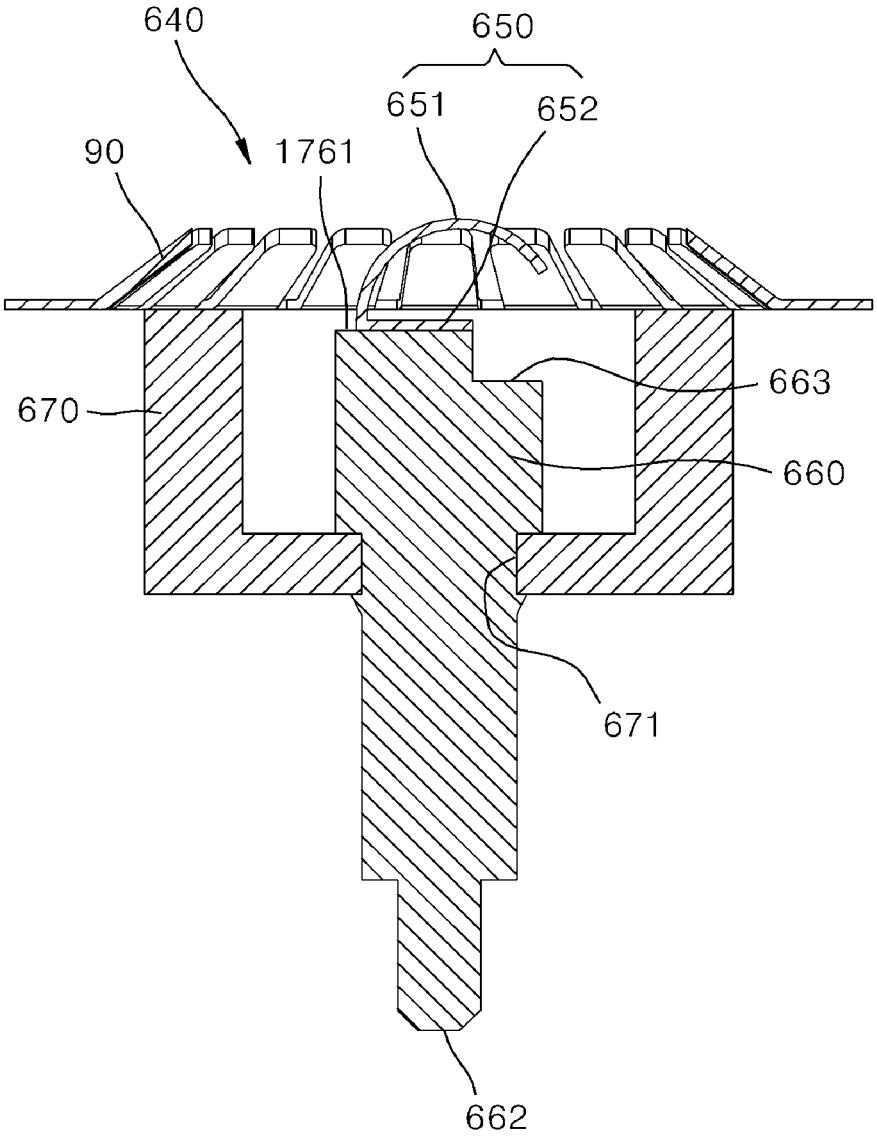
FIG. 23 is a cross-sectional view illustrating the cavity filter in accordance with the seventh embodiment of the present disclosure.
Figure 24:
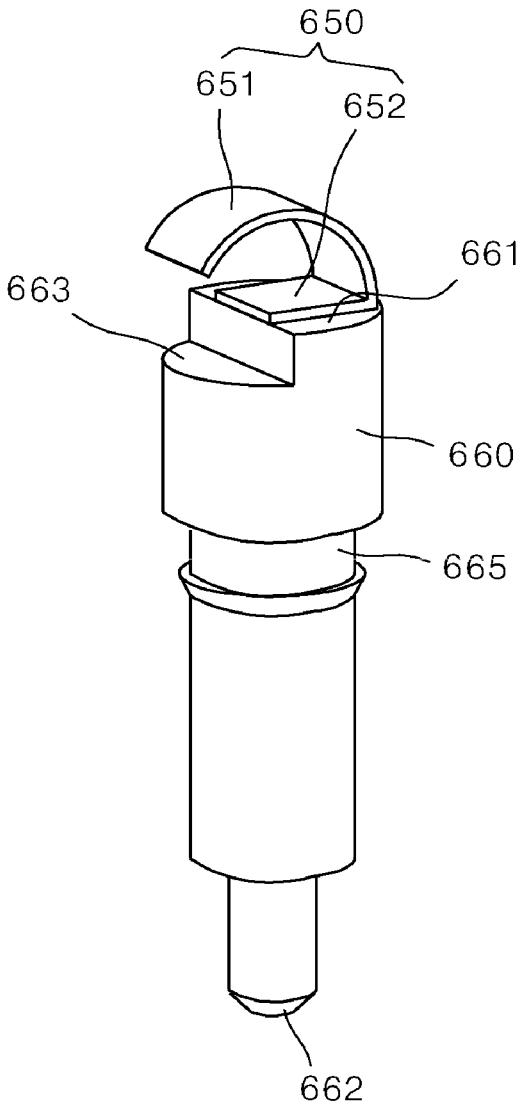
FIG. 24 is a perspective view illustrating a terminal portion among components of FIG. 22.

FIG. 22 is an exploded perspective view illustrating some components of a cavity filter in accordance with a seventh embodiment of the present disclosure, FIG. 23 is a cross-sectional view illustrating that a terminal portion is inserted and installed into a terminal insertion port among the components of FIG. 22, and FIG. 24 is a perspective view illustrating the terminal portion among the components of FIG. 22.

As illustrated in FIGS. 22 to 24, a cavity filter 20 in accordance with the seventh embodiment of the present disclosure may include a terminal portion 640 having a first side terminal 650 and a second side terminal 660. The first side terminal 650 may be elastically deformed by an assembly force provided by an assembler, and disposed at the top of a terminal insertion port 25 so as to be contacted with an electrode pad formed on an outer member 8 configured as any one of an antenna board and a PCB board. The second side terminal 660 may be disposed at the bottom of the terminal insertion port 25, and soldered and fixed to a solder hole 32 formed in a plate of an RF signal connecting portion 31.

In the cavity filter 20 in accordance with the seventh embodiment of the present disclosure, which has the above-described configuration, the terminal fixing portion 652 of the first side terminal 650 may be closely fixed to the top surface of the second side terminal 660, compared to the cavity filter 20 in accordance with the sixth embodiment. The first side terminal 650 and the second side terminal 660 may be not only fixed to each other thorough the soldering method, but also fixed to each other through any other methods using other fastening members and the like.

In the cavity filter 20 in accordance with the seventh embodiment of the present disclosure, a stop rib 663 may be formed as a stepped surface which is formed by cutting a part of the top surface 661 of the second side terminal 660 downward, compared to the cavity filter 20 in accordance with the sixth embodiment.

Since a dielectric body 670 inserted for impedance matching in the terminal insertion port 25 and the other components are configured in a similar manner to or the same manner as those of the cavity filter 20 in accordance with the sixth embodiment, the detailed descriptions thereof will be omitted herein.

Figure 25:
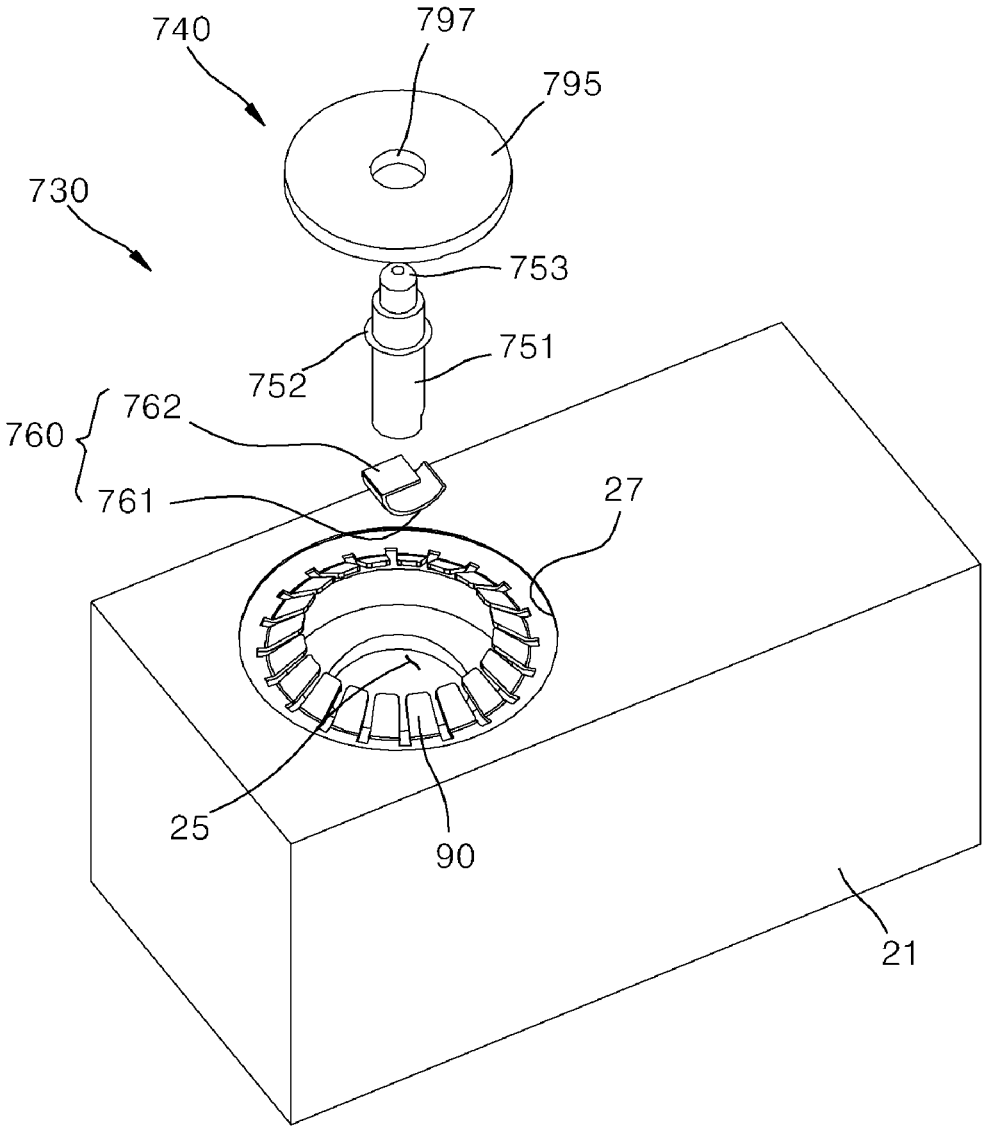
FIG. 25 is an exploded perspective view illustrating a cavity filter in accordance with an eighth embodiment of the present disclosure.
Figure 26:
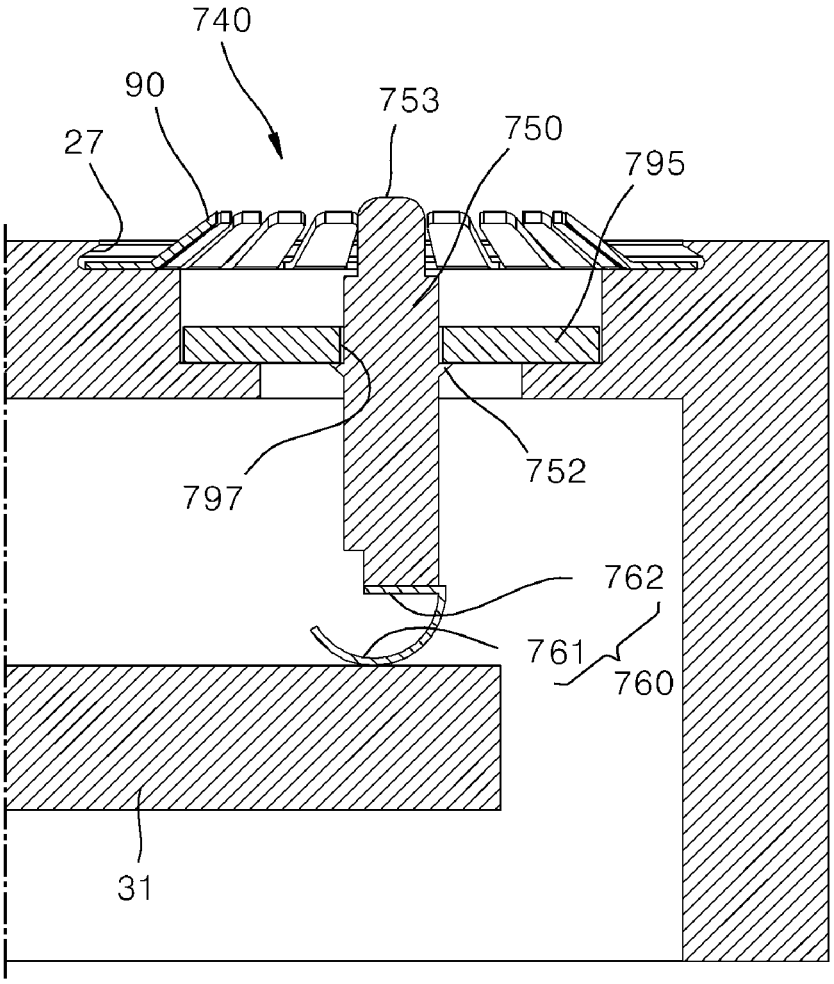
FIG. 26 is a cross-sectional view illustrating the cavity filter in accordance with the eighth embodiment of the present disclosure.
Figure 27:
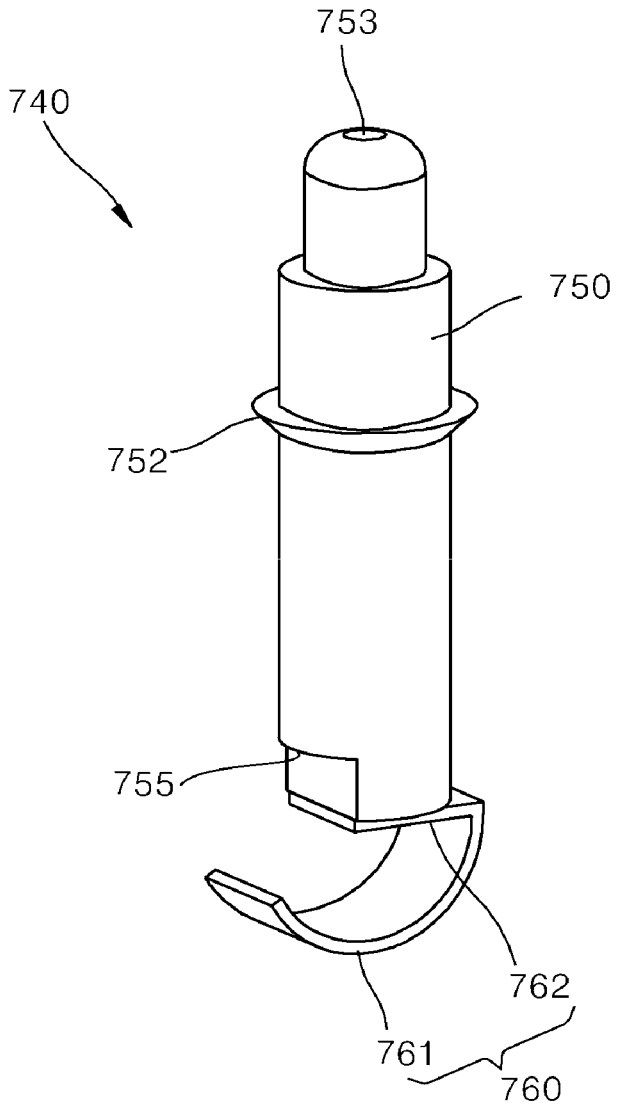
FIG. 27 is a perspective view illustrating a terminal portion among components of FIG. 25.

FIG. 25 is an exploded perspective view illustrating some components of a cavity filter in accordance with an eighth embodiment of the present disclosure, FIG. 26 is a cross-sectional view illustrating that a terminal portion is inserted and installed into a terminal insertion port among the components of FIG. 25, and FIG. 27 is a perspective view illustrating the terminal portion among the components of FIG. 25.

As illustrated in FIGS. 25 to 27, a cavity filter 20 in accordance with the eighth embodiment of the present disclosure may include a terminal portion 740 having a first side terminal 750 and a second side terminal 760. The first side terminal 750 may be disposed at the top of a terminal insertion port 25 so as to be contacted with an electrode pad formed on an outer member 8 configured as any one of an antenna board and a PCB board. The second side terminal 760 may be disposed at the bottom of the terminal insertion port 25, supported on the top surface of an RF signal connecting portion 31, and elastically deformed by an assembly force provided by an assembler.

The cavity filter 20 in accordance with the eighth embodiment of the present disclosure may further include a reinforcement plate 795 disposed in the terminal insertion port 25 and having a terminal through-hole 797 through which the first side terminal 750 is disposed.

In the cavity filter 20 in accordance with the eighth embodiment of the present disclosure, the terminal portion 740 may be moved in the top-to-bottom direction in the drawings, while guided through the terminal through-hole 797 formed in the reinforcement plate 795 by an assembly force provided by an assembler.

That is, the first side terminal 750 may include a contact portion 753 forming a predetermined contact surface with the electrode pad of the outer member 8 configured as any one of an antenna board and a PCB board. Furthermore, the first side terminal 750 may be moved vertically through the terminal through-hole 797 of the reinforcement plate 795 by an assembly force provided by an assembler. Furthermore, the first side terminal 750 may have a separation prevention rib 752 formed on the outer circumferential surface thereof. The separation prevention rib 752 may be locked to the bottom circumference of the terminal through-hole 797 of the reinforcement plate 795, and prevent the first side terminal 750 from being arbitrarily separated to the outside.

The second side terminal 760 may include a fixing portion 762 fixed to the bottom surface of the first side terminal 750 and an elastic support portion 761 extended in a round shape downward from one side of the fixing portion 762 and elastically supported on the top surface of the RF signal connecting portion 31.

When an assembly force of an assembler is provided, the leading end of the elastic support portion 761 may be elastically deformed while the first side terminal 750 is pressed downward. At this time, the elastic support portion 761 may be elastically deformed until the leading end thereof reaches a rib surface of a stop rib 755, which is formed as a stepped surface at the bottom of the first side terminal 750.

In the cavity filter 20 in accordance with the eighth embodiment of the present disclosure, which has the above-described configuration, the first side terminal 750 and the second side terminal 760 may be formed in such a shape that the first side terminal and the second side terminal of the cavity filter 20 in accordance with the seventh embodiment are turned upside down. Furthermore, in the cavity filter 20 in accordance with the eighth embodiment, a dielectric body 770 may be substituted with the reinforcement plate 95 of the cavity filter 20 in accordance with the first embodiment, as long as impedance matching design is possible.

Since the other components are configured in the same manner as or similar manner to those of the cavity filter 20 in accordance with the seventh embodiment, the detailed description thereof will be omitted herein.

Figure 28:
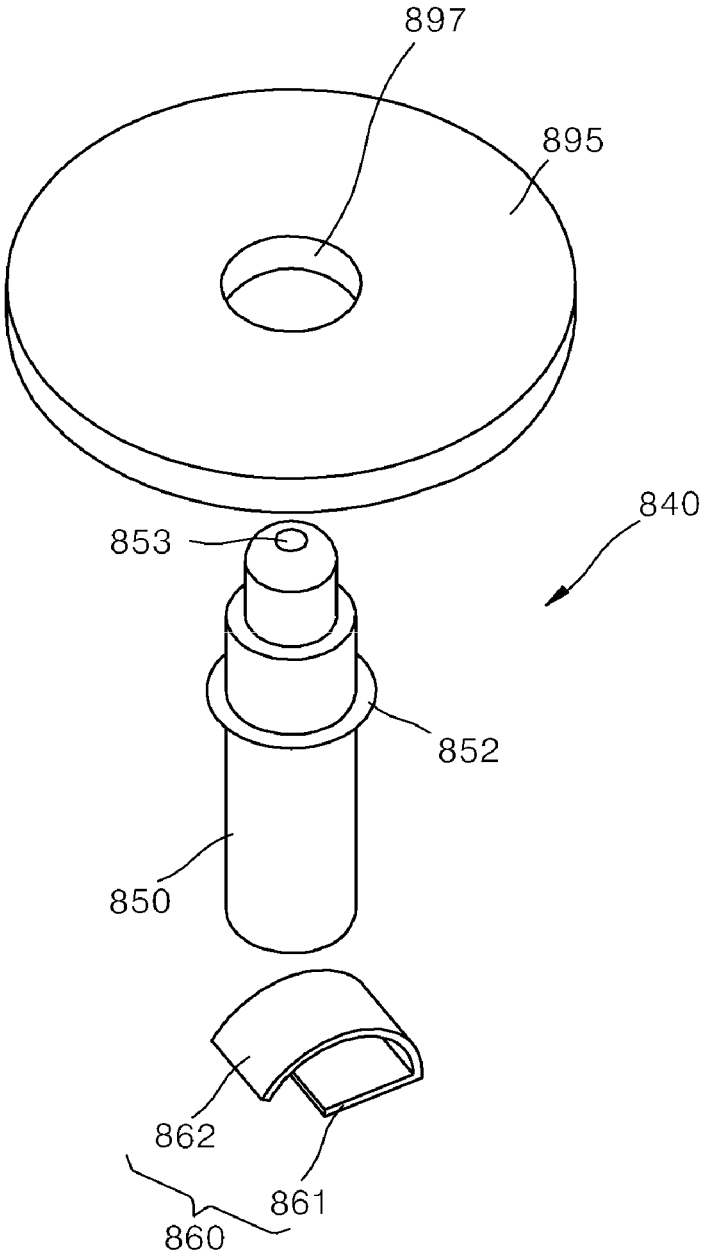
FIG. 28 is an exploded perspective view illustrating a cavity filter in accordance with a ninth embodiment of the present disclosure.
Figure 29:
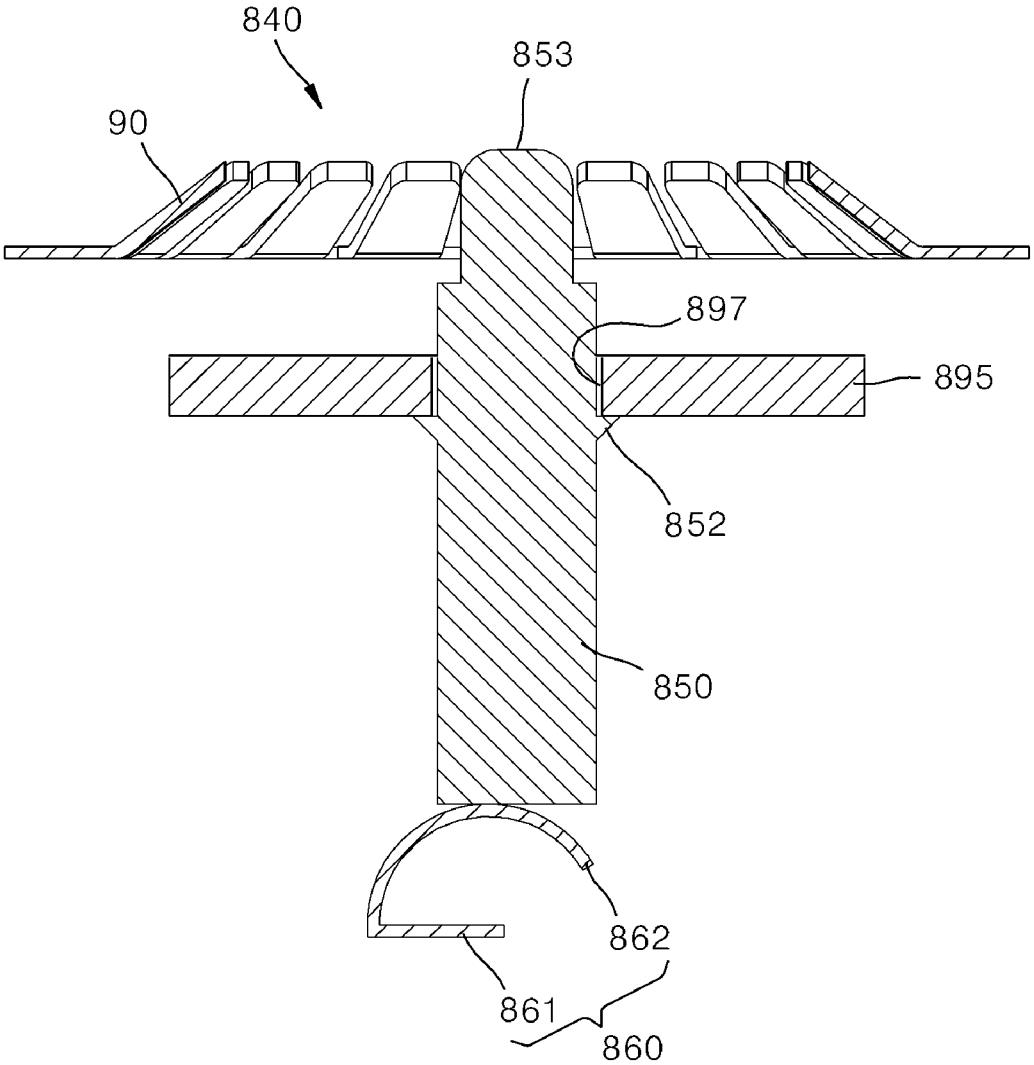
FIG. 29 is a cross-sectional view illustrating the cavity filter in accordance with the ninth embodiment of the present disclosure.
Figure 30:
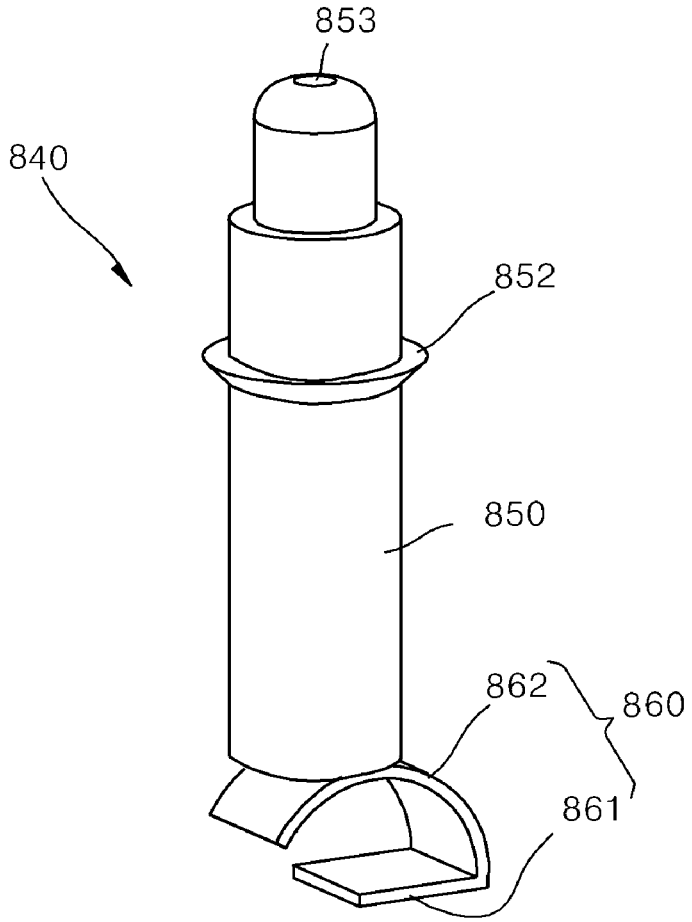
FIG. 30 is a perspective view illustrating a terminal portion among components of FIG. 28.

FIG. 28 is an exploded perspective view illustrating some components of a cavity filter in accordance with a ninth embodiment of the present disclosure, FIG. 29 is a cross-sectional view illustrating that a terminal portion is inserted and installed into a terminal insertion port among the components of FIG. 28, and FIG. 30 is a perspective view illustrating the terminal portion among the components of FIG. 28.

As illustrated in FIGS. 28 to 30, a cavity filter 20 in accordance with the ninth embodiment of the present disclosure may include a terminal portion 840 having a first side terminal 850 and a second side terminal 860. The first side terminal 850 may be disposed at the top of a terminal insertion port 25 so as to be contacted with an electrode pad formed on an outer member 8 configured as any one of an antenna board and a PCB board. The second side terminal 860 may be disposed at the bottom of the terminal insertion port 25, fixed to the top surface of an RF signal connecting portion 31, and elastically deformed by an assembly force provided by an assembler.

The second side terminal 860 of the terminal portion 840 may include a fixing portion 861 fixed to the top surface of the RF signal connecting portion 31 and an elastic support portion 862 formed in a round shape so as to be elastically supported by the bottom surface of the first side terminal 850 and elastically deformed.

In the cavity filter 20 in accordance with the ninth embodiment of the present disclosure, the elastic support portion 862 of the second side terminal 860 may support the bottom of the first side terminal 850, unlike the cavity filter 20 in accordance with the eighth embodiment, in which the elastic support portion 761 of the second side terminal 760 supports the top surface of the RF signal connecting portion 31.

In addition, a reinforcement plate 895 having a terminal through-hole 897 disposed in the terminal insertion port 25 is configured in a similar manner to or the same manner as that of the cavity filter 20 in accordance with the ninth embodiment. Thus, the detailed descriptions thereof will be omitted herein.

Figure 31:
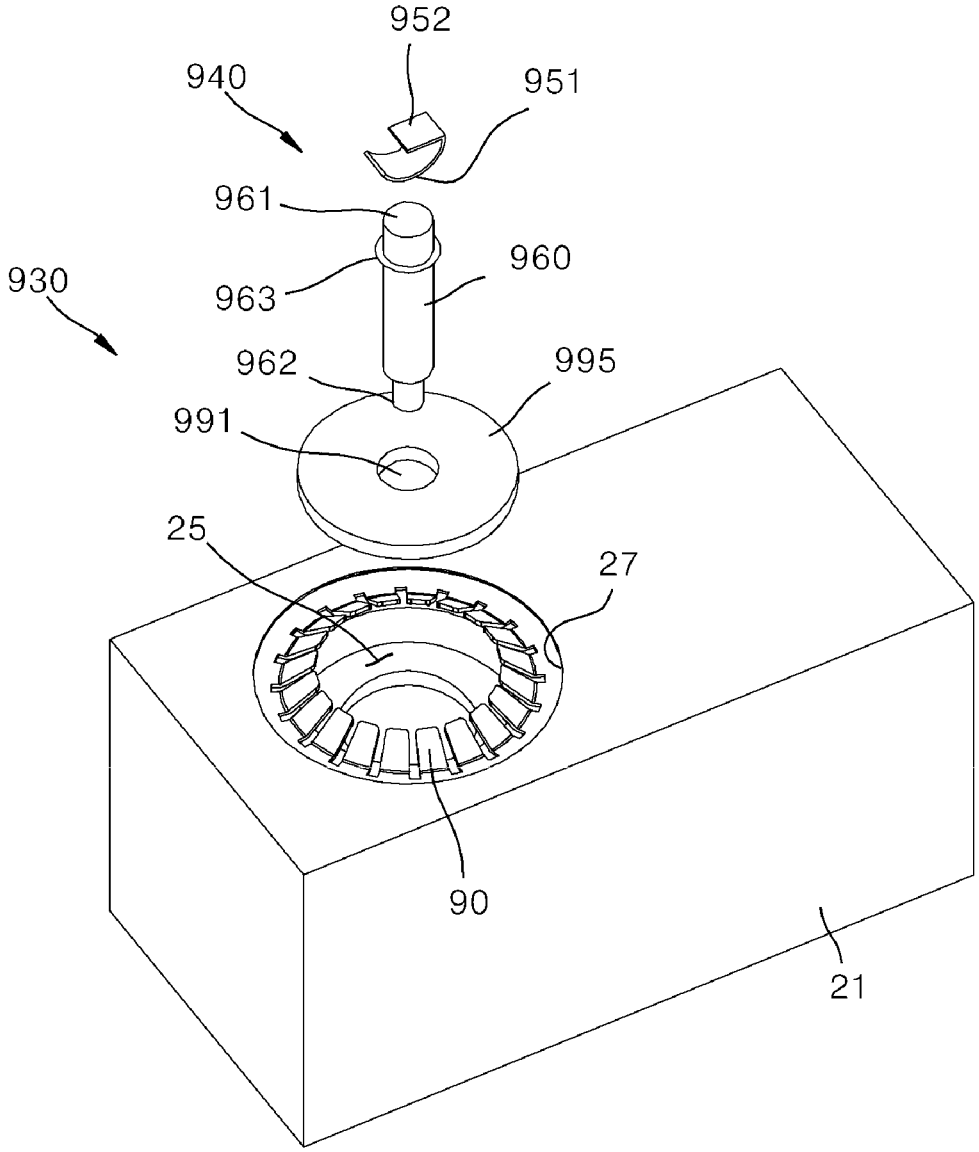
FIG. 31 is an exploded perspective view illustrating a cavity filter in accordance with a tenth embodiment of the present disclosure.
Figure 32:
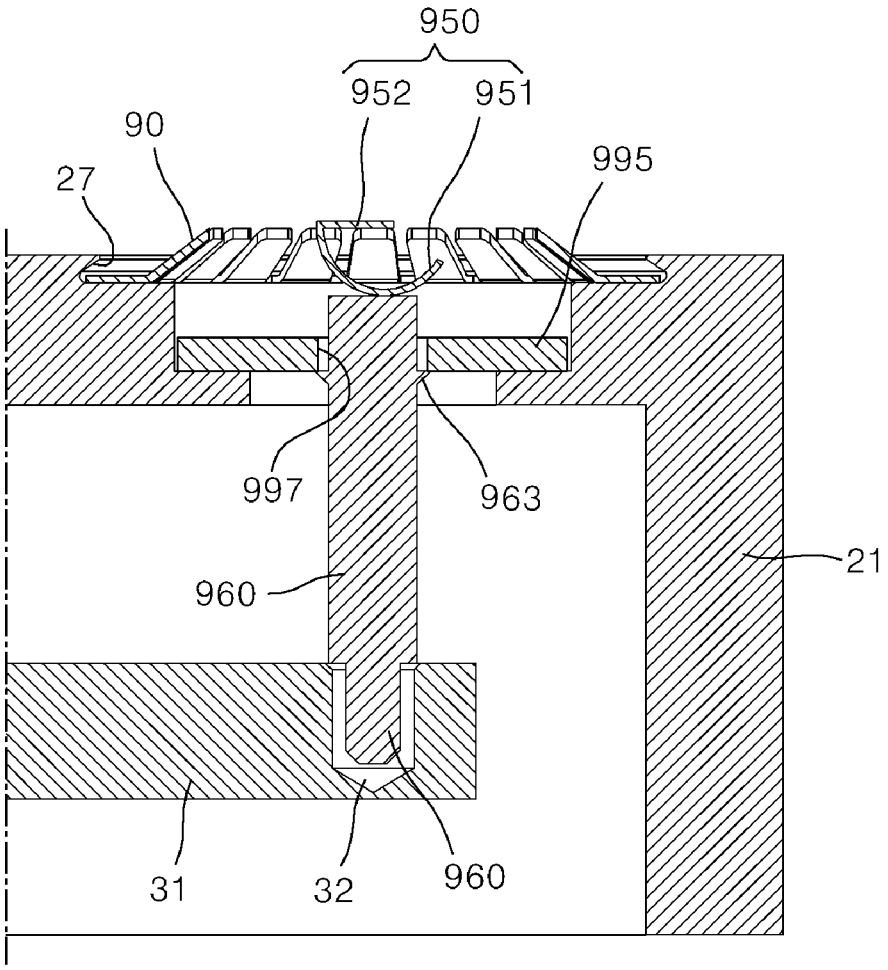
FIG. 32 is a cross-sectional view illustrating the cavity filter in accordance with the tenth embodiment of the present disclosure.
Figure 33:
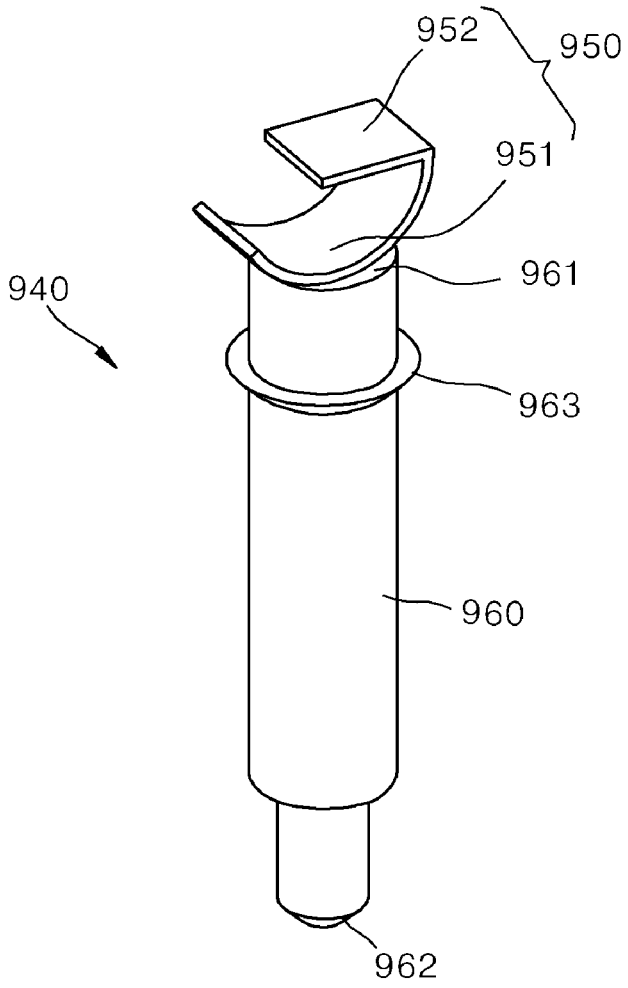
FIG. 33 is a perspective view illustrating a terminal portion among the components of FIG. 10.

FIG. 31 is an exploded perspective view illustrating some components of a cavity filter in accordance with a tenth embodiment of the present disclosure, FIG. 32 is a cross-sectional view illustrating that a terminal portion is inserted and installed into a terminal insertion port among the components of FIG. 31, and FIG. 33 is a perspective view illustrating the terminal portion among the components of FIG. 31.

As illustrated in FIGS. 31 to 33, a cavity filter 20 in accordance with the tenth embodiment of the present disclosure may include a terminal portion 640 having a first side terminal 950 and a second side terminal 960. The first side terminal 950 may be disposed at the top of a terminal insertion port 25, and fixed to one surface of an electrode pad formed on an outer member 8 configured as any one of an antenna board and a PCB board. The second side terminal 960 may have an upper end portion 961 fixed into the terminal insertion port 25 and a lower end portion 962 soldered and fixed to a solder hole 32 formed in a plate of an RF signal connecting portion 31.

The first side terminal 950 may include a fixing portion 952 and an elastic support portion 951. The fixing portion 952 may be fixed to one surface of the electrode pad of the outer member 8 configured as an antenna board and a PCB board so as to be always contacted with the electrode pad of the outer member 8. The elastic support portion 951 may be bent in a round shape and extended downward from one end of the fixing portion 952, elastically supported by the top surface of the upper end portion 961 of the second side terminal 960, and elastically deformed by an assembly force provided by an assembler.

As illustrated in FIG. 32, the upper end portion 961 of the second side terminal 960 may be disposed through a terminal through-hole 997 of a reinforcement plate 995 provided in the terminal insertion port 25, and the lower end portion 962 thereof may be soldered and fixed to the solder hole 32 formed in the plate of the RF signal connecting portion 31. Furthermore, the second side terminal 960 may have a separation prevention rib 963 formed on the outer circumferential surface thereof, the separation prevention rib 963 being locked to the bottom circumference of the terminal through-hole 997 of the reinforcement plate 995 so as to prevent the second side terminal 960 from being separated to the outside of the terminal insertion port 25.

In the cavity filter 20 in accordance with the tenth embodiment of the present disclosure, which has the above-described configuration, the terminal portion 940 may be formed in such a shape that the terminal portion 840 of the cavity filter 20 in accordance with the ninth embodiment is turned upside down.

That is, in the cavity filter 20 in accordance with the tenth embodiment of the present disclosure, the fixing portion 952 of the first side terminal 950 of the terminal portion 940 may be closely fixed to the electrode pad formed on one surface of the outer member 8 configured as any one of an antenna board and a PCB board.

The first side terminal 950 and the second side terminal 960 may be physically separated from each other. However, when an assembly force of an assembler is provided as illustrated in FIG. 32, the elastic support portion 951 of the first side terminal 950 may be elastically deformed to continuously support the top surface of the second side terminal 960, thereby absorbing assembly tolerance in the terminal insertion port 25 and simultaneously preventing disconnection of an electric flow.

Figure 34:
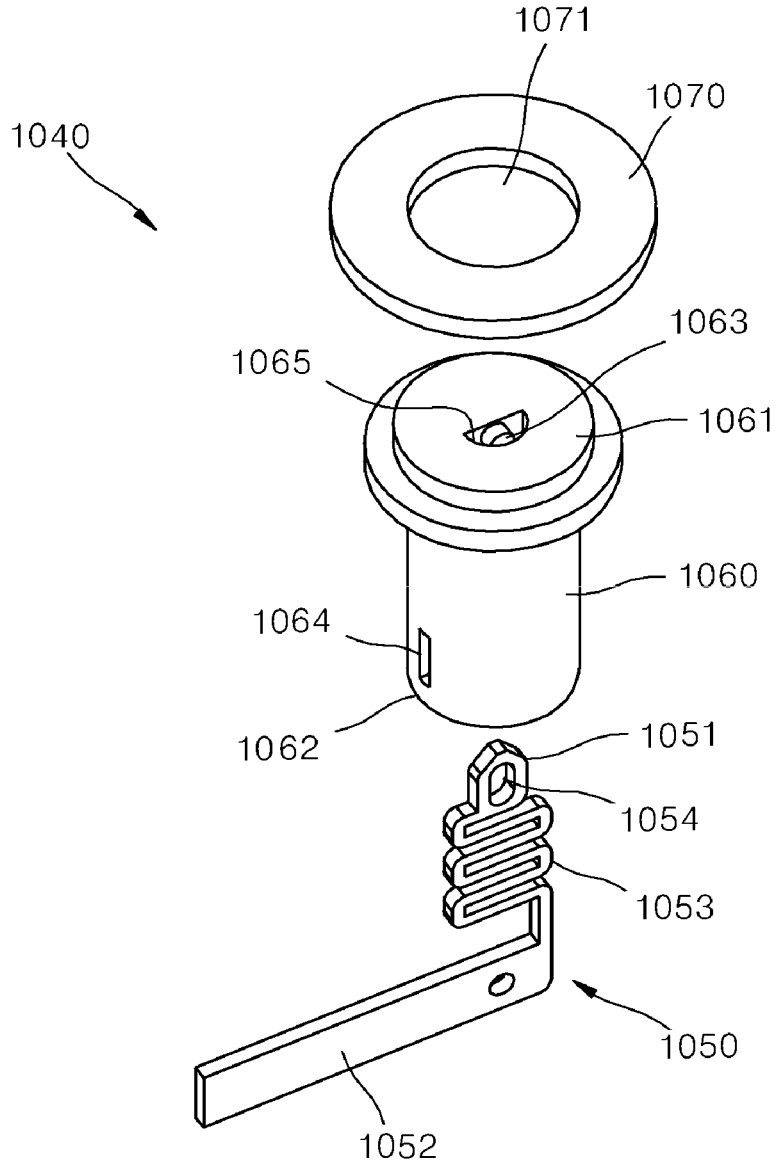
FIG. 34 is an exploded perspective view illustrating a cavity filter in accordance with an 11th embodiment of the present disclosure.
Figure 35:
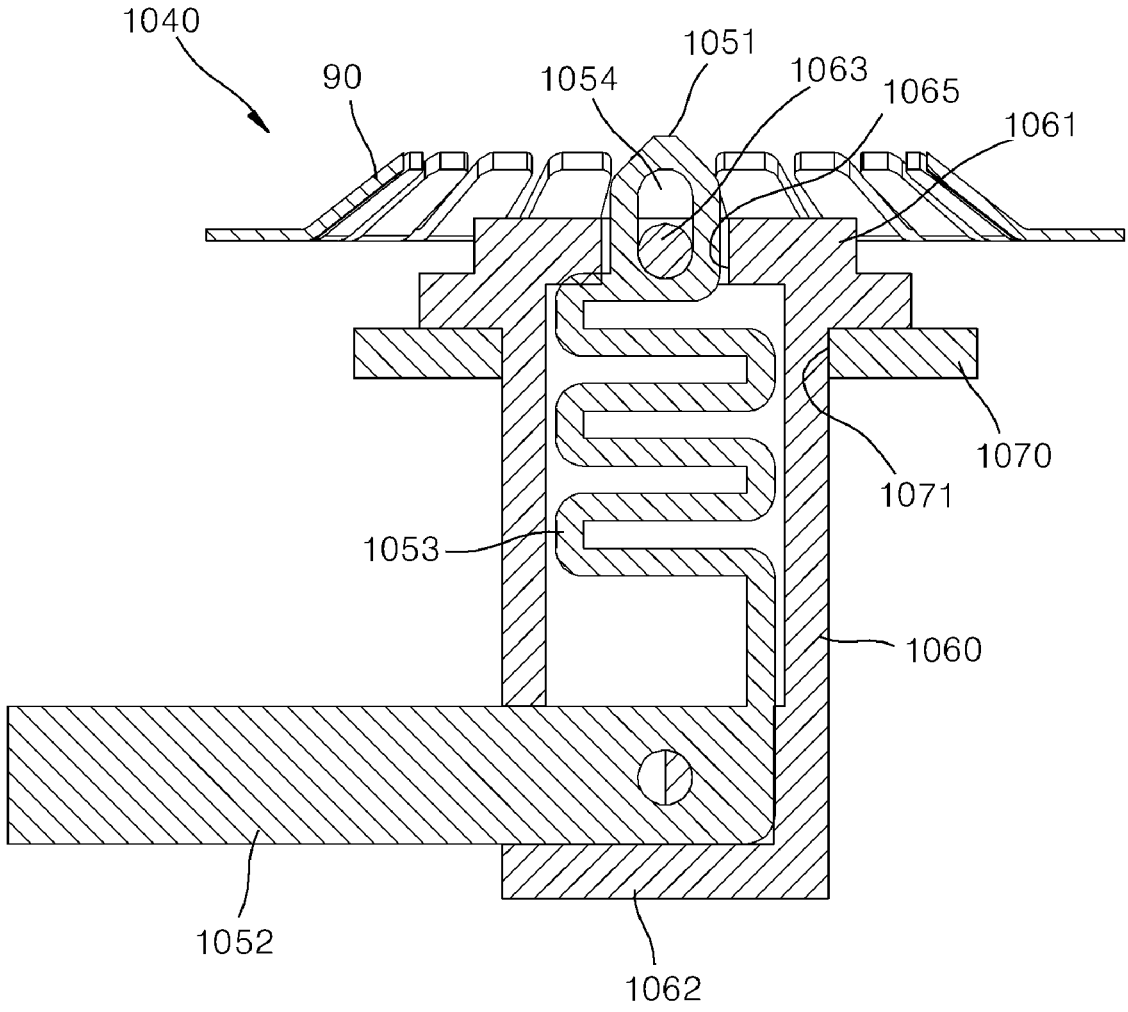
FIG. 35 is a cross-sectional view illustrating the cavity filter in accordance with the 11th embodiment of the present disclosure.
Figure 36:
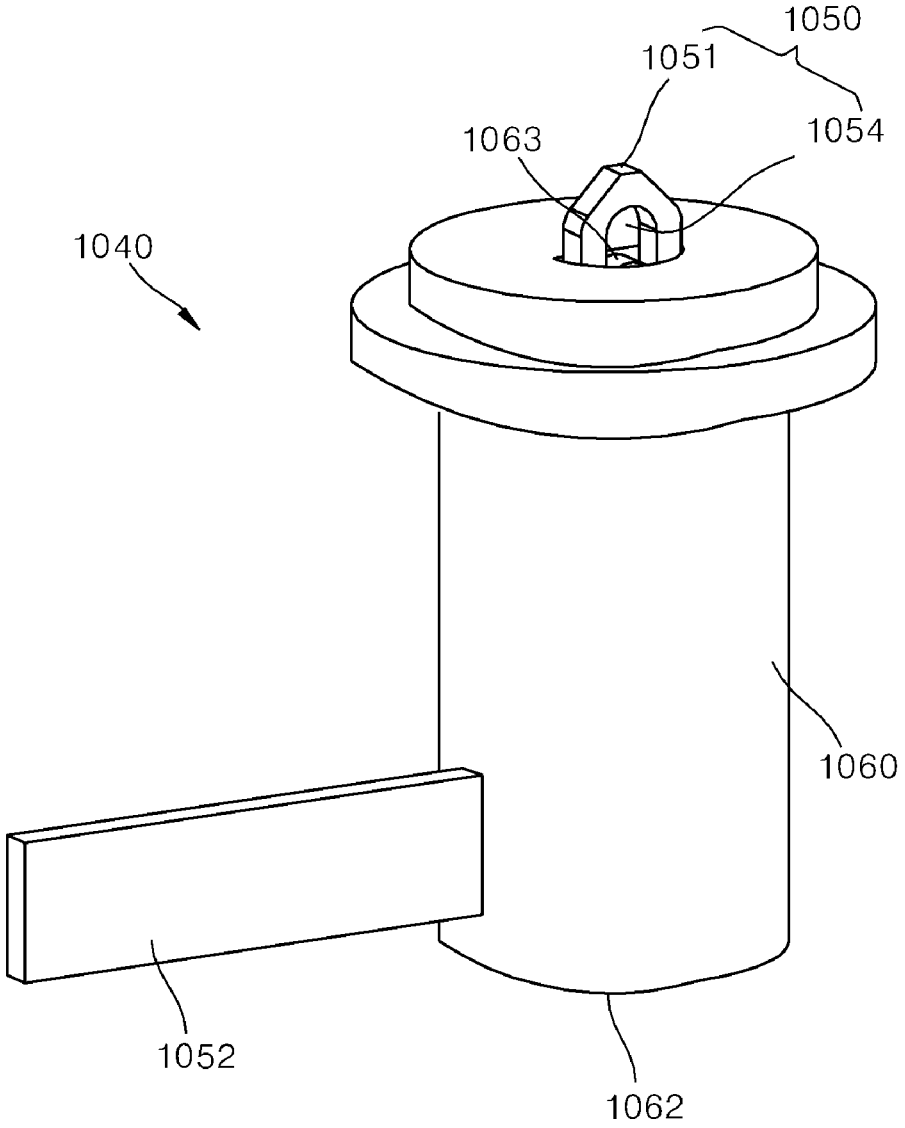
FIG. 36 is a perspective view illustrating a terminal portion among the components of FIG. 34.

FIG. 34 is an exploded perspective view illustrating some components of a cavity filter in accordance with an 11th embodiment of the present disclosure, FIG. 35 is a cross-sectional view illustrating that a terminal portion is inserted and installed into a terminal insertion port among the components of FIG. 34, and FIG. 36 is a perspective view illustrating the terminal portion among the components of FIG. 34.

As illustrated in FIGS. 34 to 36, a cavity filter 20 in accordance with the 11th embodiment of the present disclosure may include a terminal portion 1040 having a contact portion 1051, a horizontal connection portion 1052 and an elastic terminal portion 1053. The contact portion 1051 may be disposed in a terminal insertion port 25 so as to be contacted with an electrode pad formed on one surface of an outer member 8 which is configured as any one of an antenna board and a PCB board and disposed above the terminal insertion port 25. The horizontal connection portion 1052 may be bent and extended from the bottom of the contact portion 1051 toward an RF signal connecting portion 31 provided on one side right under the terminal insertion port 25. The elastic terminal portion 1053 may be disposed between the contact portion 1051 and the horizontal connection portion 1052, and bent and connected in a zigzag shape in a horizontal direction. Even in this case, a separate plate extended horizontally from the RF signal connecting portion 31 may be omitted.

The cavity filter 20 in accordance with the 11th embodiment of the present disclosure may further include a dielectric body 1060 disposed in the terminal insertion port 25 so as to cover the components of the terminal portion 1040 except the upper end portion of the contact portion 1051 and a part of the horizontal connection portion 1052.

The dielectric body 1060 may have a contact portion-side through-hole 1065 and a connection portion-side through-hole 1064. The contact portion-side through-hole 1065 may be formed at the top surface 1061 of the dielectric body 1060 such that the upper end portion of the contact portion 1051 protrudes upward through the contact portion-side through-hole 1065, and the connection portion-side through-hole 1064 may be formed at the outer circumferential surface of the bottom 1062 of the dielectric body 1060 such that the horizontal connection portion 1052 horizontally passes through the connection portion-side through-hole 1064.

The dielectric body 1060 may further include a guide bar 1063 horizontally connected to the connection portion-side through-hole 1065 thereof, and the guide bar 1063 may be disposed through a guide slot 1054 which is vertically formed and elongated by cutting an upper end portion where the contact portion 1051 is formed. Thus, when the elastic terminal portion 1053 is elastically deformed by an assembly force provided by an assembler, the movement of the contact portion 1051 in the top-to-bottom direction may be stably guided. The elastic terminal portion 1053 may serve as an elastic deformation portion which absorbs assembly tolerance existing in the terminal insertion port 25 by the assembly force provided by the assembler.

Figure 37:
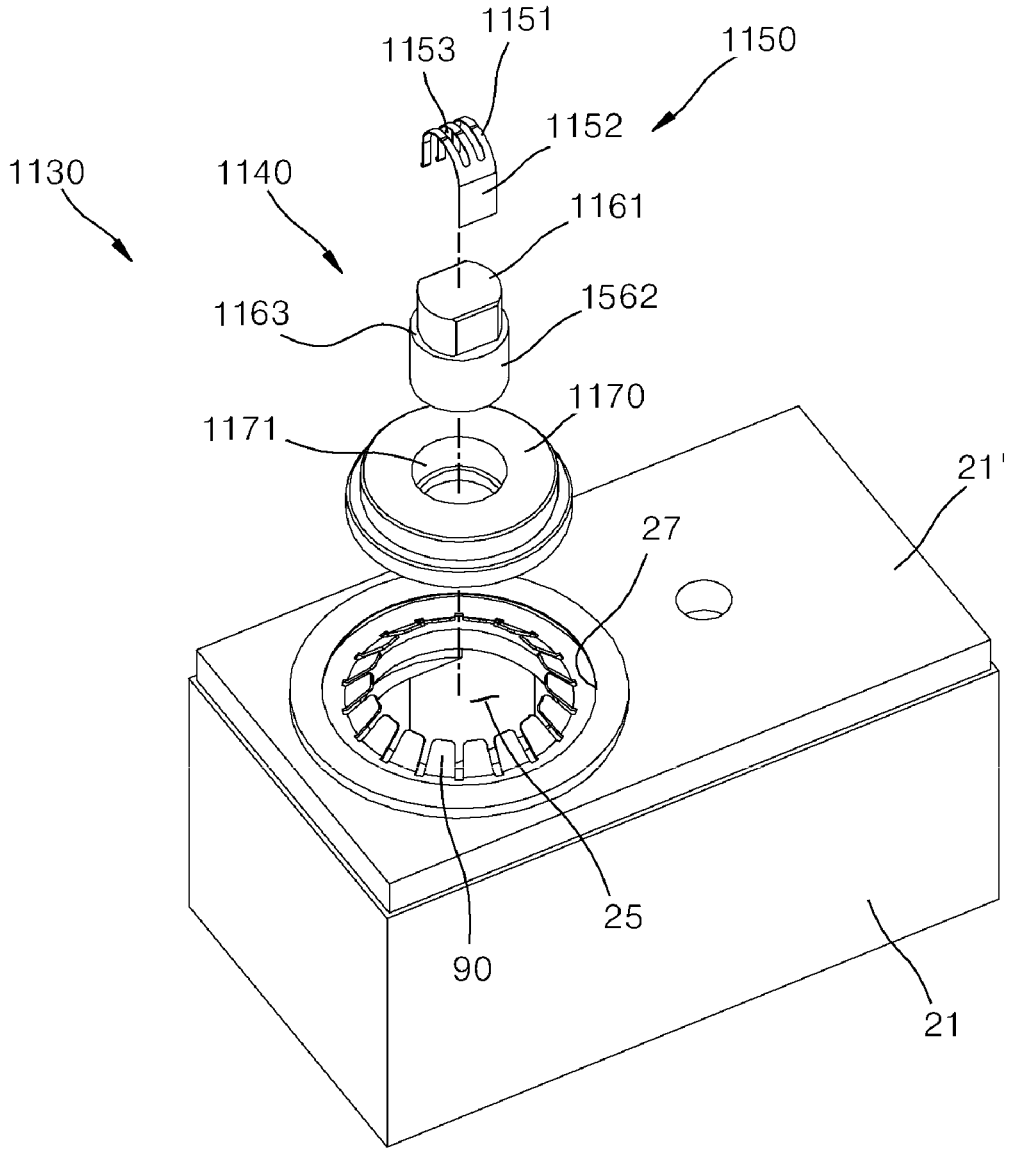
FIG. 37 is an exploded perspective view illustrating a cavity filter in accordance with a 12th embodiment of the present disclosure.
Figure 38:
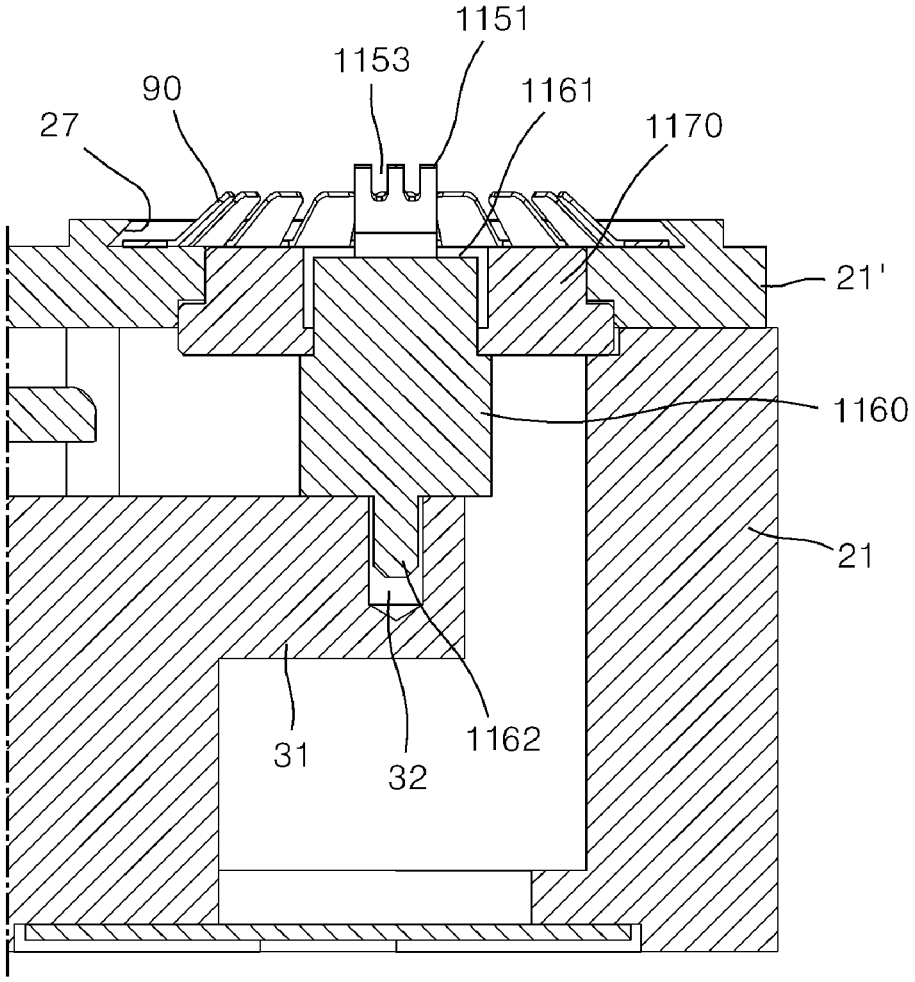
FIG. 38 is a cross-sectional view illustrating the cavity filter in accordance with the 12th embodiment of the present disclosure.
Figure 39:
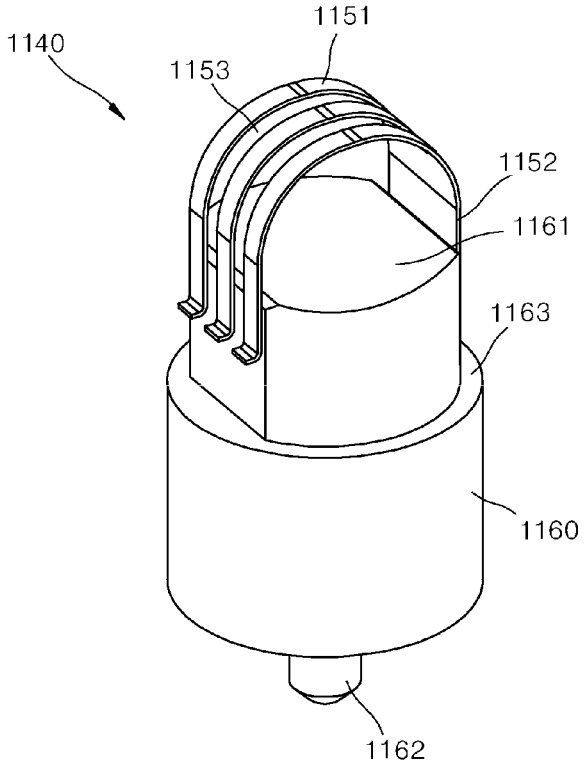
FIG. 39 is a perspective view illustrating a terminal portion among components of FIG. 37.

FIG. 37 is an exploded perspective view illustrating some components of a cavity filter in accordance with a 12th embodiment of the present disclosure, FIG. 38 is a cross-sectional view illustrating that a terminal portion is inserted and installed into a terminal insertion port among the components of FIG. 37, and FIG. 39 is a perspective view illustrating the terminal portion among the components of FIG. 37.

As illustrated in FIGS. 37 to 39, a cavity filter 20 in accordance with the 12th embodiment of the present disclosure may include a terminal portion 1140 having a first side terminal 1150 and a second side terminal 1160. The first side terminal 1150 may be disposed at the top of a terminal insertion port 25 so as to be contacted with an electrode pad formed on one surface of an outer member 8 configured as any one of an antenna board and a PCB board. The second side terminal 1160 may be disposed at the bottom of the terminal insertion port 25, and soldered and fixed to the solder hole 32 formed in the plate of an RF signal connecting portion 31.

The first side terminal 1150 may include a contact portion 1151 and a terminal fixing portion 1152, like that of the cavity filter 20 in accordance with the sixth embodiment which has been already described. The contact portion 1151 may be formed in a round shape such that the top thereof is contacted with the electrode pad, and the terminal fixing portion 1152 may be vertically extended from the bottom of the contact portion 1151, and fixed to the second side terminal 1160.

The cavity filter 20 in accordance with the 12th embodiment of the present disclosure is different from the cavity filter 20 in accordance with the sixth embodiment in that the contact portion 1151 of the first side terminal 1150 includes a plurality of terminal cut portions 1153 to divide the contact portion 1151 into three or more pieces. That is, as illustrated in FIG. 39, the contact portion 1151 of the first side terminal 1150 may include two terminal cut portions 1153 to divide the contact portion 1151 into three pieces. The possibility that the contact portion 1151 will be elastically deformed by an assembly force provided by an assembler may be further increased.

Furthermore, the terminal fixing portion 1152 of the first side terminal 1150 may be fixed to a side surface of an upper end portion 1161 of the second side terminal 1160 through any one of various methods such as a soldering method and a fastening method by a fastening member.

Furthermore, the second side terminal 1160 may have a stop rib 1163 protruding outwardly from the outer circumferential surface thereof, the stop rib 1163 serving to prevent excessive elastic deformation in the contact portion 1151 of the first side terminal 1150. The lower end protrusion 1162 is a component which is same or similar to the lower end protrusion 562 of the sixth embodiment of the present disclosure, and detailed description thereof will be omitted.

Since a dielectric body 1170 inserted for impedance matching in the terminal insertion port 25 and the other components are configured in a similar manner to or the same manner as those of the cavity filter 20 in accordance with the sixth embodiment, the detailed descriptions thereof may be replaced with those of the sixth embodiment.

Figure 40:
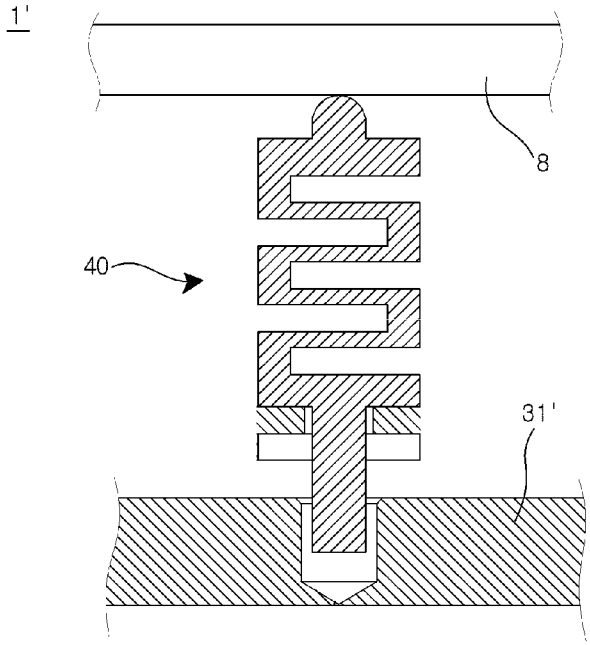
FIG. 40 is a cross-sectional view illustrating a connecting structure in accordance with an embodiment of the present disclosure.

FIG. 40 is a cross-sectional view illustrating a connecting structure in accordance with an embodiment of the present disclosure.

So far, it has been described that each of the cavity filters in accordance with the various embodiments of the present disclosure is manufactured as one module, and attached to one surface of the outer member 8 configured as an antenna board or a PCB board. However, the embodiments of the present disclosure are not necessarily limited thereto. According to a modification illustrated in FIG. 40, the cavity filter may be implemented as a connecting structure 1' including the terminal portion 40 which is provided between the electrode pad provided on one surface of the outer member 8 and another connection member 31', and makes an electrical connection with the connection member 31', regardless of whether the cavity filter is manufactured in the form of a module.

The above-described contents are only exemplary descriptions of the technical idea of the present disclosure, and those skilled in the art to which the present disclosure pertains may change and modify the present disclosure in various manners without departing from the essential properties of the present disclosure.

Therefore, the embodiments disclosed in the present disclosure do not limit but describe the technical idea of the present disclosure, and the scope of the technical idea of the present disclosure is not limited by the embodiments. The scope of the protection of the present disclosure should be construed by the following claims, and all technical ideas within a range equivalent to the claims should be construed as being included in the scope of rights of the present disclosure.

INDUSTRIAL APPLICABILITY

The present disclosure provides a cavity filter which can have a slimmer and more compact structure because an RF connector is embedded in the filter body in the thickness direction thereof, be assembled through an assembly method capable of minimizing the accumulation amount of assembly tolerance which occurs when a plurality of filters are assembled, facilitate the RF signal connection structure to be easily mounted and uniformly maintain the frequency characteristics of the filters, and provide stable connection by applying lateral tension while allowing a relative motion, thereby preventing degradation in antenna performance, and a connecting structure included therein.

What is claimed is:

1. A cavity filter, comprising:

a filter body;

a terminal insertion port provided in the filter body as a hollow space; and a terminal portion, provided in the terminal insertion port, and is configured to electrically connect an electrode pad, provided above the filter body, to an RF (radiofrequency) signal connector which is spaced apart from the electrode pad and provided below the terminal insertion port, wherein the terminal portion comprises a cylinder-shaped terminal body, wherein a first end of the terminal portion is in contact with the electrode pad, and a second end of the terminal portion, provided on an opposite side of the first end, is coupled to the RF signal connector, and wherein the terminal body comprises at least one cut out portion formed on a side wall of the terminal body, wherein the terminal body comprises a plurality of cut out portions, including the at least one cut out portion, formed on the side wall of the terminal body along a longitudinal direction of the terminal body.

2. The cavity filter of claim 1, wherein the plurality of cut out portions comprises a first plurality of cut out portions formed by partially chamfering the side wall of the terminal body from one side to an opposite side by a first depth.

3. The cavity filter of claim 2, wherein the plurality of cut out portions further comprises a second plurality of cut out portions formed by partially chamfering the side wall of the terminal body from the opposite side to the one side by the first depth.

4. The cavity filter of claim 3, wherein the first plurality of cut out portions and the second plurality of cut out portions are provided alternately along the longitudinal direction of the terminal body.

5. The cavity filter of claim 3, wherein the chamfered parts of the first plurality of cut out portions and the second plurality of cut out portions are formed such that the chamfered parts of the first plurality of cut out portions partially overlap with chamfered parts of the second plurality of cut out portions when viewed from the first end to the second end of the terminal portion.

6. The cavity filter of claim 1, wherein the terminal portion further comprises a cylinder-shaped lower end portion, and wherein a diameter of the lower end portion is smaller than a diameter of the terminal body.

7. The cavity filter of claim 6, wherein the lower end portion of the terminal portion is soldered to the RF signal connector.

8. The cavity filter of claim 1, wherein the terminal body is made of a conductive material.

9. The cavity filer of claim 1, further comprising a dielectric body inserted between the terminal portion and the terminal insertion port to surround at least a part of the terminal portion.

10. The cavity filer of claim 1, wherein the terminal portion is comprises of a single body which is deformable by an assembly force.

11. A cavity filter, comprising:

a filter body;

a terminal insertion port provided in the filter body as a hollow space; and a terminal portion, provided in the terminal insertion port, and is configured to electrically connect an electrode pad, provided above the filter body, to an RF (radiofrequency) signal connector which is spaced apart from the electrode pad and provided below the terminal insertion port, wherein the terminal portion comprises a cylinder-shaped terminal body, wherein a first end of the terminal portion is in contact with the electrode pad, and a second end of the terminal portion, provided on an opposite side of the first end, is coupled to the RF signal connector, and wherein the terminal body comprises at least one cut out portion formed on a side wall of the terminal body, wherein the cavity filter further comprises an insertion slot support portion which protrudes from a wall of the terminal insertion port to support a bottom surface of the terminal body, and wherein the cavity filter further comprises a reinforcement plate supported by the insertion slot support portion, and the reinforcement plate supports at least a part of a lower surface of the terminal body.

12. The cavity filter of claim 11, wherein the reinforcement plate comprises a through hole, and the lower end portion of the terminal portion penetrates the through hole.

13. The cavity filter of claim 11, wherein the terminal body is made of a conductive material.

14. The cavity filer of claim 11, further comprising a dielectric body inserted between the terminal portion and the terminal insertion port to surround at least a part of the terminal portion.

15. The cavity filer of claim 11, wherein the terminal portion is comprises of a single body which is deformable by an assembly force.

16. A cavity filter, comprising:

a filter body;

a terminal insertion port provided in the filter body as a hollow space; and a terminal portion, provided in the terminal insertion port, and is configured to electrically connect an electrode pad, provided above the filter body, to an RF (radiofrequency) signal connector which is spaced apart from the electrode pad and provided below the terminal insertion port, wherein the terminal portion comprises a cylinder-shaped terminal body, wherein a first end of the terminal portion is in contact with the electrode pad, and a second end of the terminal portion, provided on an opposite side of the first end, is coupled to the RF signal connector, and wherein the terminal body comprises at least one cut out portion formed on a side wall of the terminal body, wherein the cavity filter further comprises:

a washer installation portion formed as a groove on an upper surface of the filter body, and a star washer installed on the washer installation portion, wherein an outer edge of the star washer is locked to the washer installation portion.

17. The cavity filter of claim 16, wherein the star washer comprises a plurality of support pieces which are upwardly inclined from the outer edge toward a center of the terminal insertion port, wherein the plurality of support pieces cover at least a part of an upper surface of the terminal body, and at least a part of the upper end portion of the terminal portion protrudes passing upper surfaces of the plurality of support pieces.

18. The cavity filter of claim 16, wherein the terminal body is made of a conductive material.

19. The cavity filer of claim 16, further comprising a dielectric body inserted between the terminal portion and the terminal insertion port to surround at least a part of the terminal portion.

* * * * *